US007095382B2

(12) United States Patent
Surducan et al.

(10) Patent No.: US 7,095,382 B2
(45) Date of Patent: Aug. 22, 2006

(54) MODIFIED PRINTED DIPOLE ANTENNAS FOR WIRELESS MULTI-BAND COMMUNICATIONS SYSTEMS

(75) Inventors: Emanoil Surducan, Cluj-Napoca (RO); Daniel Iancu, Pleasantville, NY (US); John Glossner, Carmel, NY (US)

(73) Assignee: Sandbridge Technologies, Inc., White Plains, NY (US)

( * ) Notice: Subject to any disclaimer, the term of this patent is extended or adjusted under 35 U.S.C. 154(b) by 45 days.

(21) Appl. No.: 10/859,169

(22) Filed: Jun. 3, 2004

(65) Prior Publication Data

US 2005/0110698 A1 May 26, 2005

Related U.S. Application Data

(63) Continuation-in-part of application No. 10/718,568, filed on Nov. 24, 2003, now Pat. No. 7,034,769.

(51) Int. Cl.
*H01Q 9/16* (2006.01)
*H01Q 1/38* (2006.01)

(52) U.S. Cl. ..... 343/793; 343/795; 343/700 MS

(58) Field of Classification Search ..... 343/793, 343/795, 893

See application file for complete search history.

(56) References Cited

U.S. PATENT DOCUMENTS

| | | | | |
|---|---|---|---|---|
| 4,438,437 | A | 3/1984 | Burgmyer | 343/770 |
| 4,513,292 | A * | 4/1985 | Bowman | 343/795 |
| 4,860,019 | A | 8/1989 | Jiang et al. | |
| 5,030,962 | A | 7/1991 | Rees | 343/700 MS |
| 5,532,708 | A * | 7/1996 | Krenz et al. | 343/795 |
| 5,949,383 | A | 9/1999 | Hayes et al. | 343/795 |
| 5,982,335 | A | 11/1999 | Faraone et al. | |
| 5,986,606 | A | 11/1999 | Kossiavas et al. | 343/700 MS |
| 6,072,434 | A | 6/2000 | Papatheodorou | 343/700 MS |
| 6,239,765 | B1 | 5/2001 | Johnson et al. | 343/795 |
| 6,275,192 | B1 | 8/2001 | Kim | 343/700 MS |
| 6,300,908 | B1 | 10/2001 | Jecko et al. | 343/700 MS |
| 6,339,404 | B1 * | 1/2002 | Johnson et al. | 343/794 |
| 6,346,921 | B1 | 2/2002 | Excell et al. | 343/792.5 |
| 6,353,443 | B1 | 3/2002 | Ying | 343/702 |
| 6,404,394 | B1 | 6/2002 | Hill | 343/702 |
| 6,407,710 | B1 | 6/2002 | Keilen et al. | 343/702 |
| 6,424,311 | B1 * | 7/2002 | Tsai et al. | 343/795 |
| 6,429,818 | B1 | 8/2002 | Johnson et al. | 343/702 |
| 6,509,882 | B1 | 1/2003 | McKivergan | 343/818 |
| 6,603,430 | B1 | 8/2003 | Hill et al. | 343/702 |
| 6,621,464 | B1 | 9/2003 | Fang et al. | 343/795 |
| 6,624,793 | B1 | 9/2003 | Su et al. | 343/795 |
| 6,806,843 | B1 | 10/2004 | Killen et al. | |

(Continued)

OTHER PUBLICATIONS

Smith, K.: "Antennas for low power applications," RFM$_{\text{®}}$, AN36A-070898, undated.

(Continued)

*Primary Examiner*—Trinh Vo Dinh
(74) *Attorney, Agent, or Firm*—Barnes & Thornburg LLP

(57) ABSTRACT

A dipole antenna for a wireless communication device, which includes a first conductive element superimposed on a portion of and separated from a second conductive element by a first dielectric layer. A first conductive via connects the first and second conductive elements through the first dielectric layer. The second conductive element is generally U-shaped. The second conductive element includes a plurality of spaced conductive strips extending transverse from adjacent ends of the legs of the U-shape. Each strip is dimensioned for a different center frequency λ0. The first conductive element may be replaced by a coaxial feed directly to the second conductive element.

36 Claims, 23 Drawing Sheets

U.S. PATENT DOCUMENTS

| | | | | |
|---|---|---|---|---|
| 2004/0113858 | A1* | 6/2004 | Tsai et al. | 343/792 |
| 2004/0140941 | A1* | 7/2004 | Joy et al. | 343/795 |

OTHER PUBLICATIONS

Wang, H.Y. et al.: "Simulation of microstrip small antennas," Vector Fields Limited, UK, APP-025-06-02, undated.

McKinzie, W. et al.: "Novel packaging approaches for miniature antennas," IMAPS/SMTA Conf. on Telecom Hardware Solutions, Plano, TX (May 2002).

Dietrich, C.B. et al.: "Trends in antennas for wireless communications," Microwave Journal (Jan. 2003).

Friedziuszko, S.J. et al.: "Dielectric materials, devices, and circuits," IEEE Trans. Microwave Theory Tech., vol. 50, pp. 706-719 (Mar. 2002).

Kaneda, N. et al.: "A broad-band planar quasi-Yagi antenna," IEEE Trans. Antennas Propagat., vol. 50, pp. 1158-1160 (Aug. 2002).

Li, R. et al.: "Development and analysis of a folded shorted-patch antenna with reduced size," School of Electrical & Computer Engineering, Georgia Institute of Technology, Atlanta, GA, undated.

Wong, K.: "Planar antennas for WLAN applications," Dept. of Electrical Engineering, Nat'l Sun Yat-Sen University, Kaohsiung, Taiwan (2002).

Zharov et al., "Nonlinear Properties of Left-Handed Metamaterials" The American Physical Society, Physical Review Letters, vol. 91, No. 3 (2003).

Mosallaei et al. "Engineered Meta-Substrates for Antenna Miniaturization" URSI EMTS (2004).

* cited by examiner

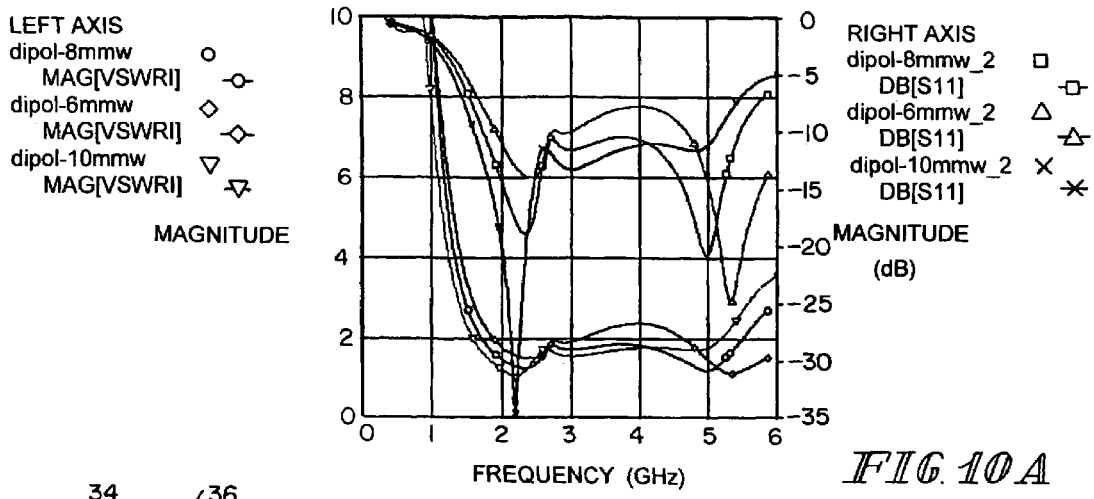
FIG. 10A
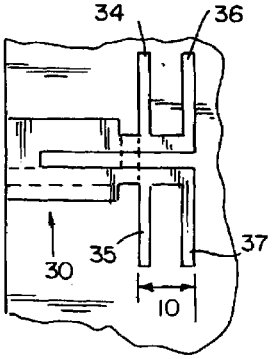
FIG. 10B1
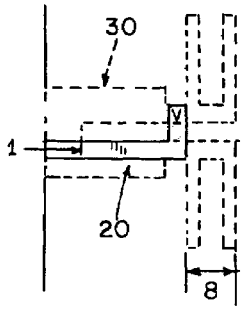
FIG. 10B2
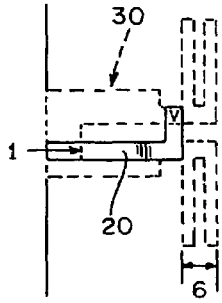
FIG. 10B3

MODIFIED PRINTED DIPOLE ANTENNAS FOR WIRELESS MULTI-BAND COMMUNICATIONS SYSTEMS

CROSS REFERENCE

This is a continuation-in-part of U.S. patent application Ser. No. 10/718,568 filed on Nov. 24, 2003,now U.S. Pat. No. 7,034,769.

BACKGROUND AND SUMMARY OF THE DISCLOSURE

The present disclosure relates to an antenna for wireless communication devices and systems and, more specifically, to printed dipole antennas for communication for wireless multi-band communication systems.

Wireless communication devices and systems are generally hand held or are part of portable laptop computers. Thus, the antenna must be of very small dimensions in order to fit the appropriate device. The system is used for general communication, as well as for wireless local area network (WLAN) systems. Dipole antennas have been used in these systems because they are small and can be tuned to the appropriate frequency. The shape of the printed dipole is generally a narrow, rectangular strip with a width less than 0.05 $\lambda 0$ and a total length less than 0.5 $\lambda 0$. The theoretical gain of the $\lambda/2$ dipole (with reference to the isotropic radiator) is generally 2.15 dBi and for a dipole antenna (two wire $\lambda/4$ length, middle excited, also with reference to the isotropic radiator) is equal to 1.76 dBi.

The present disclosure is a printed dipole antenna for a wireless communication device. It includes a first conductive element superimposed on a portion of and separated from a second conductive element by a first dielectric layer. A first conductive via connects the first and second conductive elements through the first dielectric layer. The second conductive element is generally U-shaped. The second conductive element includes a plurality of spaced conductive strips extending transverse from adjacent ends of the legs of the U-shape. Each strip on a leg is dimensioned for a different center frequency $\lambda 0$ than another strip on the same leg.

The first conductive element may be L-shaped and one of the legs of the L-shape being superimposed on one of the legs of the U-shape. The first conductive via connects the other leg of the L-shape to the other leg of the U-shape. Alternatively, the first conductive element may be connected to the ends of the strips by individual vias.

The first and second conductive elements are each planar. The strips may have a width of less than 0.05 $\lambda 0$ and a length of less than 0.5 $\lambda 0$.

The antenna may be omni-directional or directional. If it is directional, it includes a ground plane conductor superimposed and separated from the second conductive element by a second dielectric layer. A third conductive element is superimposed and separated from the strips of the second conductive element by the first dielectric layer. A second conductive via connects the third conductive element to the ground conductor through the dielectric layers. The first and third conductive elements may be co-planar. The third conductive element includes a plurality of fingers superimposed on a portion of lateral edges of each of the strips.

These and other aspects of the present disclosure will become apparent from the following detailed description of the disclosure, when considered in conjunction with accompanying drawings.

BRIEF DESCRIPTION OF DRAWINGS

FIG. 10A is a graph showing the effects of changing the width of the dipole of FIG. 1, as illustrated in FIG. 10B.

FIG. 24D is a side view of a via of FIGS. 24B and C.

DETAILED DESCRIPTION OF THE PREFERRED EMBODIMENTS

Although the present antenna of a system will be described with respect to WLAN dual frequency bands of, approximately 2.4 GHz and 5.2 GHz, and GSM and 3G multiband wireless communication devices, of approximately 0.824–0.960 GHz, 1.710–1.990 GHz and 1.885–2.200 GHz, the present antenna can be designed for operation in any of the frequency bands for portable, wireless communication devices. These could include GPS (1.575 GHz) or Blue Tooth Specification (2.4–2.5 GHz) frequency ranges.

Figure 1:
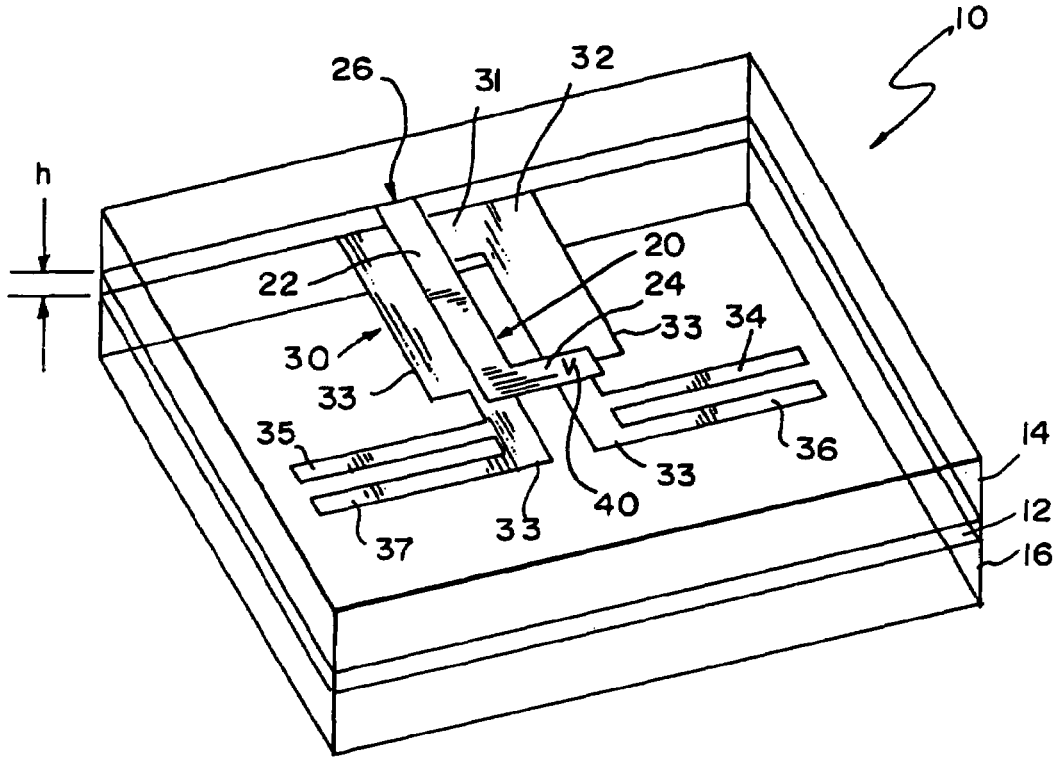
FIG. 1 is a perspective, diagrammatic view of an omni-directional, quad-band dipole antenna incorporating the principles of the present invention.
Figure 2A:
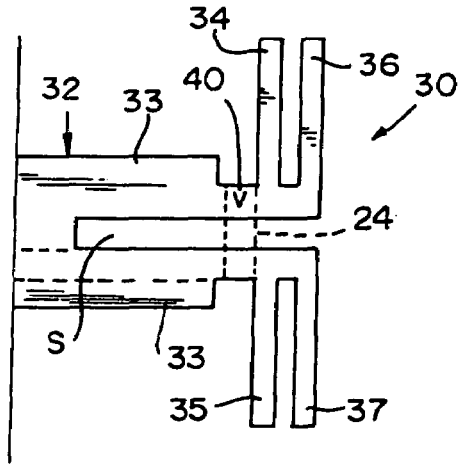
FIG. 2A is a plane view of the dipole conductive layers of FIG. 1.
Figure 3:
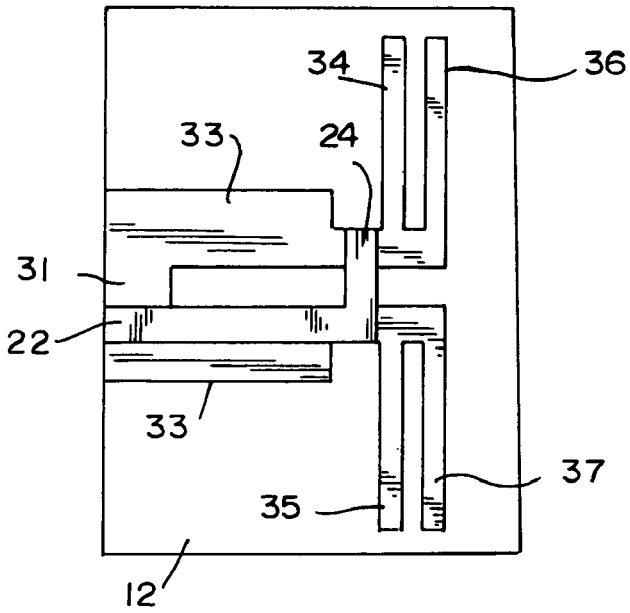
FIG. 3 is a plane view of the antenna of FIG. 1.

The antenna system 10 of FIGS. 1, 2A and 3 includes a dielectric substrate 12 with cover layers 14, 16. Printed on the substrate 12 is a first conductive layer 20, which is a micro-strip line, and on the opposite side is a split dipole conductive layer 30. The first conductive layer 20 is generally L-shaped having legs 22, 24. The second conductive layer 30 includes a generally U-shaped strip balloon line portion 32 having a bight 31 and a pair of separated legs 33. Extending transverse and adjacent the ends of the legs 33 are a plurality of strips 35, 37, 34, 36. Leg 22 of the first conductive layer 20 is superimposed upon one of the legs 33 of the second conductive layer 30 with the other leg 24 extending transverse a pair of legs 33. A conductive via 40 connects the end of leg 24 to one of the legs 33 through the dielectric substrate 12. Terminal 26 at the other end of leg 22 of the first conductive layer 20 receives the drive for the antenna 10.

The four strips 34, 36, 35 and 37 are each uniquely dimensioned so as to be tuned to or receive different frequency signals. Alternatively, each strip on a respective leg is uniquely dimensioned so as to be tuned to or receive different frequency signal than the other strip or strips on the same leg. They are each dimensioned such that the strip has a width less than 0.05 λ0 and a total length of less than 0.5 λ0.

Figure 2B:
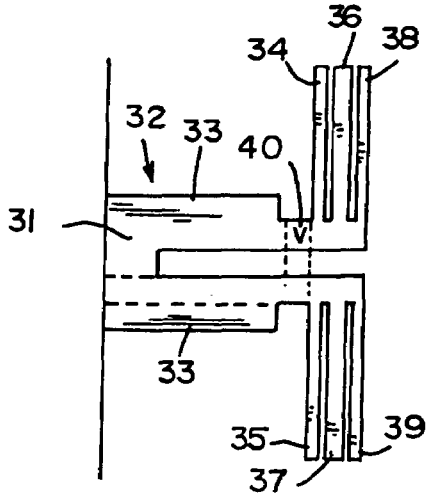
FIG. 2B is a wide-band modification of the dipole conductive layer of FIG. 2A.

FIG. 2B shows a modification of FIG. 2A, including six strips 35, 37, 39, 34, 36, 38 each extending from an adjacent end of the legs 33 of the second conductive layer 30. This allows tuning and reception of wide frequency bands. The strips of both embodiments are generally parallel to each other.

The dielectric substrate 12 may be a printed circuit board, a fiberglass or a flexible film substrate made of polyimide. Covers 14, 16 may be additional, applied dielectric layers or may be hollow casing structures. Preferably, the conductive layers 20, 30 are printed on the dielectric substrate 12.

Figure 4:
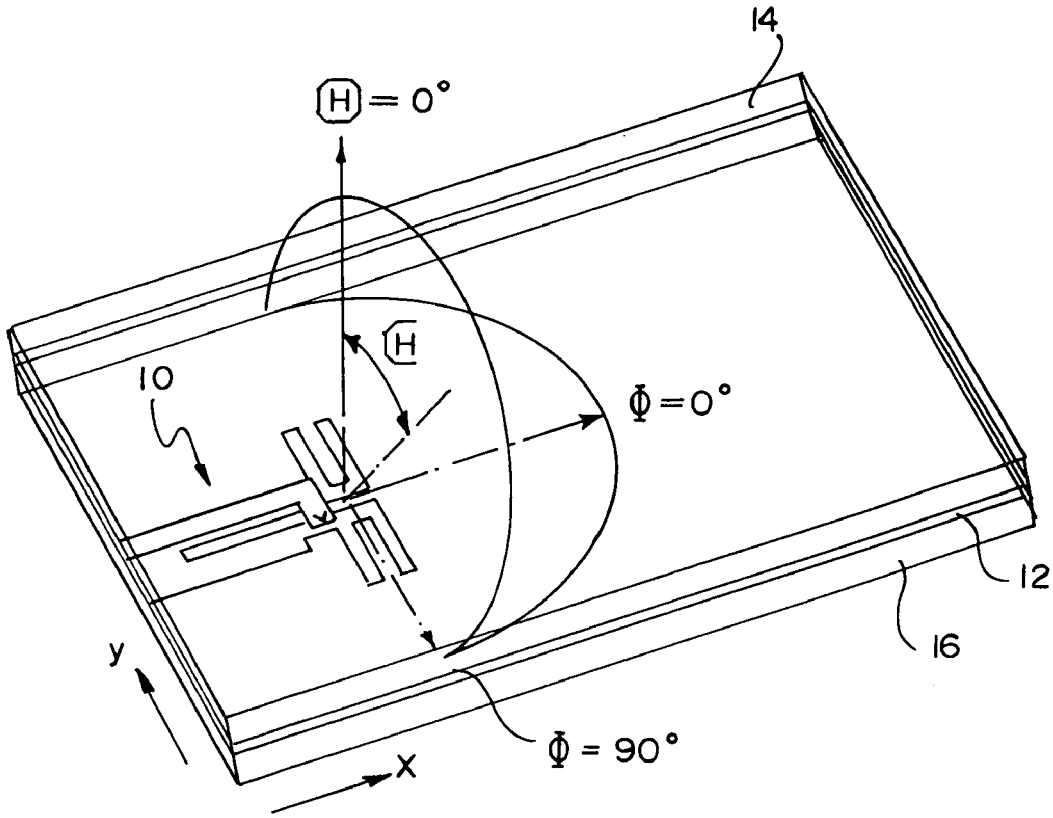
FIG. 4 is a coordinates diagram of the antenna of FIG. 1.
Figure 5:
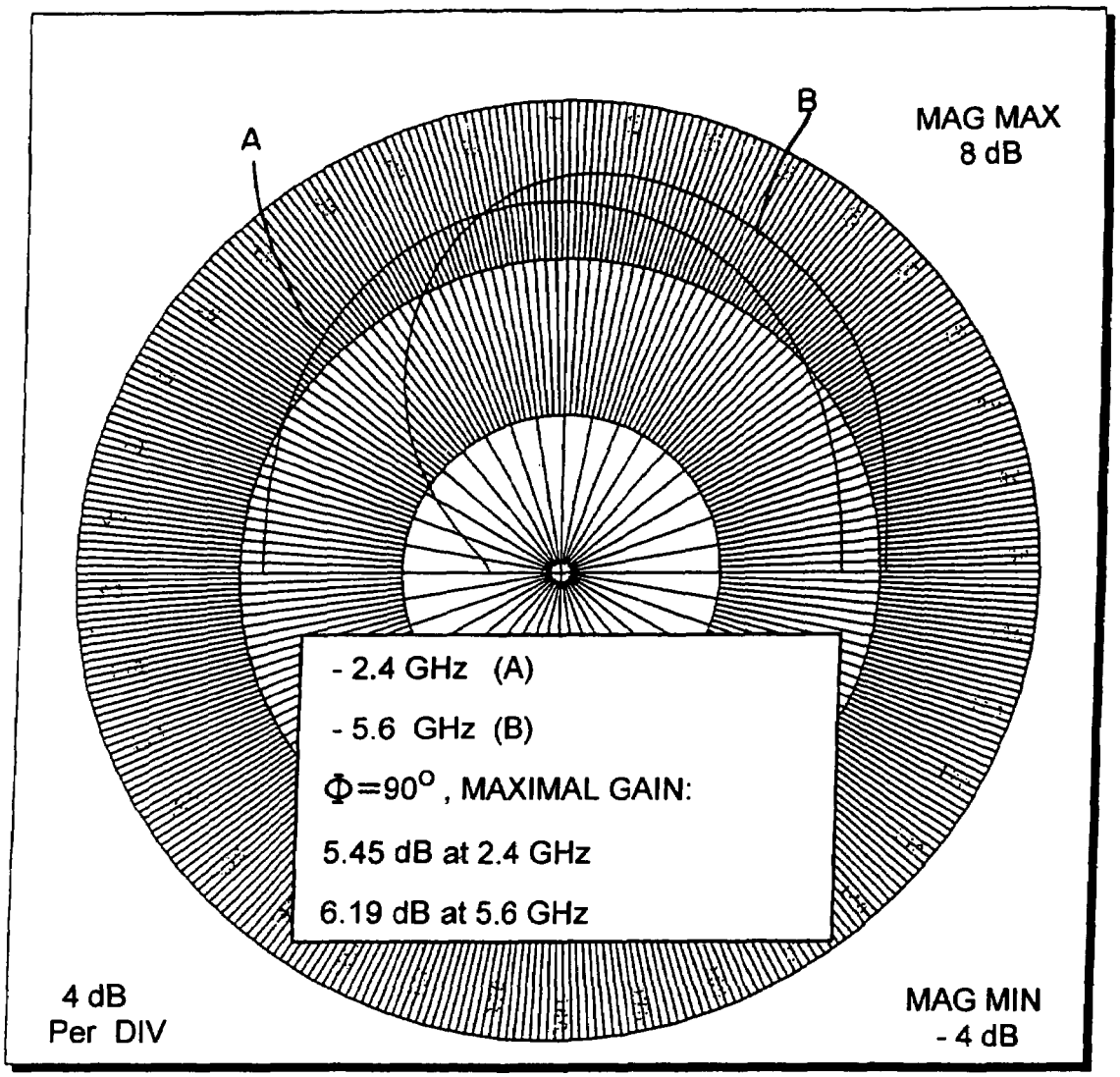
FIG. 5 is a graph of the directional gain of two of the tuned frequencies.
Figure 6:
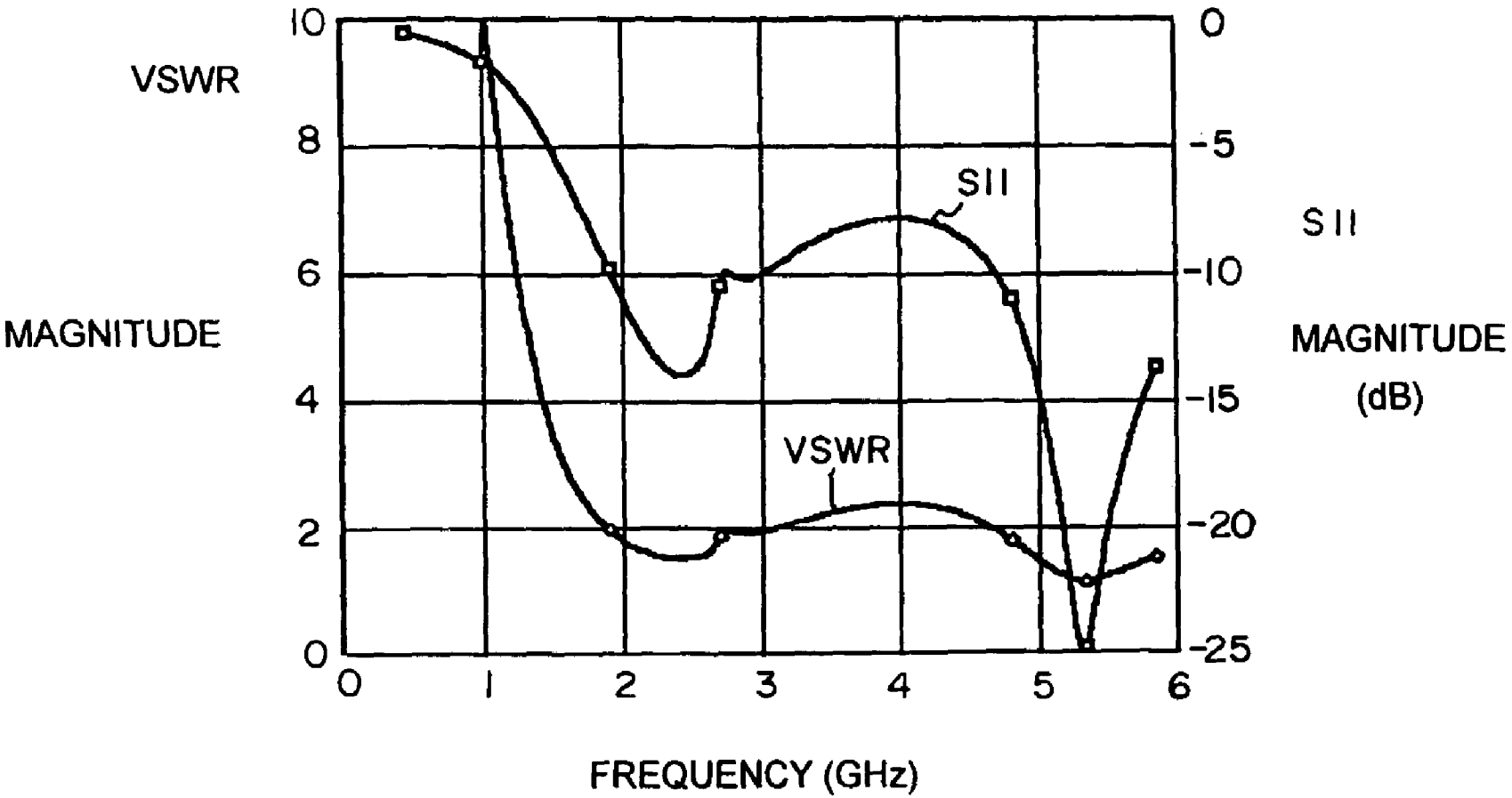
FIG. 6 is a graph of the frequency versus voltage standing wave ratio (VSWR) and the gain of S11.

As an example of the quad-band dipole antenna of FIG. 1, the frequencies may be in the range of, for example, 2.4–2.487, 5.15–5.25, 2.25–5.35 and 5.74–5.825 GHz. For the directional diagram of FIG. 4, the directional gain is illustrated in FIG. 5 for two of the frequencies 2.4 GHz (Graph A) and 5.6 GHz (Graph B). A maximal gain at 90 degrees is 5.45 dB at 2.4 GHz and 6.19 dB at 5.6 GHz. VSWR and the magnitude S11 are illustrated in FIG. 6. VSWR is below 2 at the 2.4 GHz and the 5.6 GHz frequency bands. The bands from 5.15–5.827 merge at the 5.6 GHz frequency.

The height h of the dielectric substrate 12 will vary depending upon the permeability or dielectric constant of the layer.

The narrow, rectangular strips 34, 36, 35, 37 of the appropriate dimension increases the total gain by reducing the surface waves and loss in the conductive layer. The number of conductive strips also effects the frequency sub-band.

The position of the via 40 and the width slot S between the legs 33 of the U-shaped sub-conductor 32 effect the antenna performance related to the gain "distributions" in the frequency bands. A width of slot dimensions S and the location of the via 40 are selected so as to have approximately the same gain in all of the frequency bands of the strips 34, 36, 35, 37. The maximum theoretical gain obtained are above 4 dB and are 5.7 dB at 2.4 GHz and 7.5 dB at 5.4 GHz.

Figure 7A:
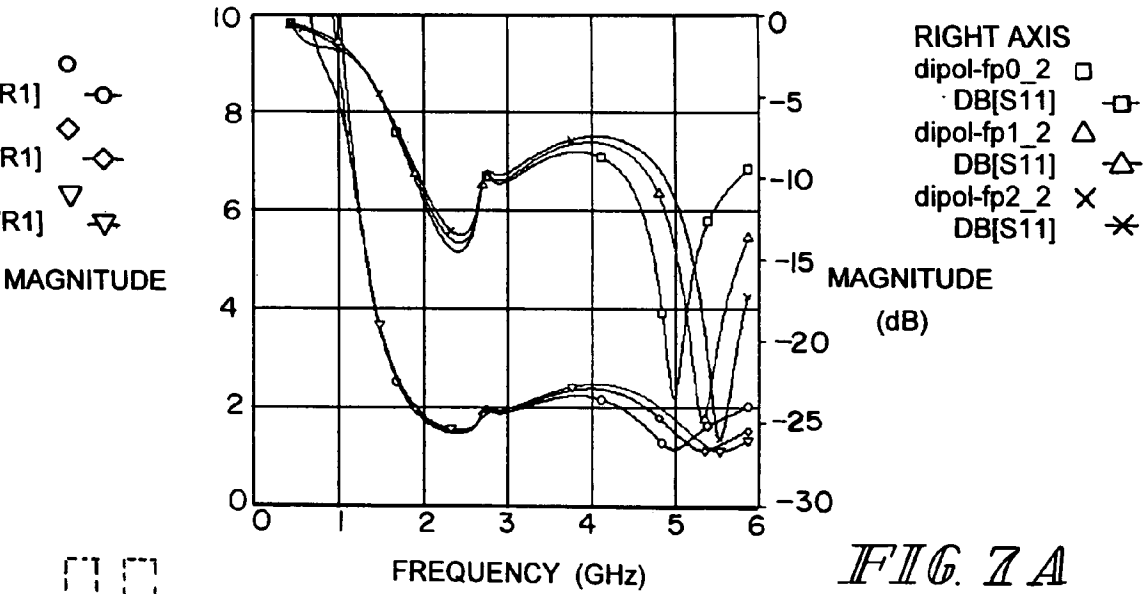
FIG. 7A is a graph showing the effects of changing the feed point or via on the characteristics of the dipole antenna of FIG. 1, as illustrated in FIG. 7B.

FIG. 7A is a graph for the various positions of the feed point fp or via 40 and the effect on VSWR and S11. The center feed point fp1 corresponds to the results of FIG. 6. Although the change of the feed point fp has a small effect in gain, it has a greater effect in shifting the λ0 at the second frequency band in the 5 GHz range.

Figure 8:
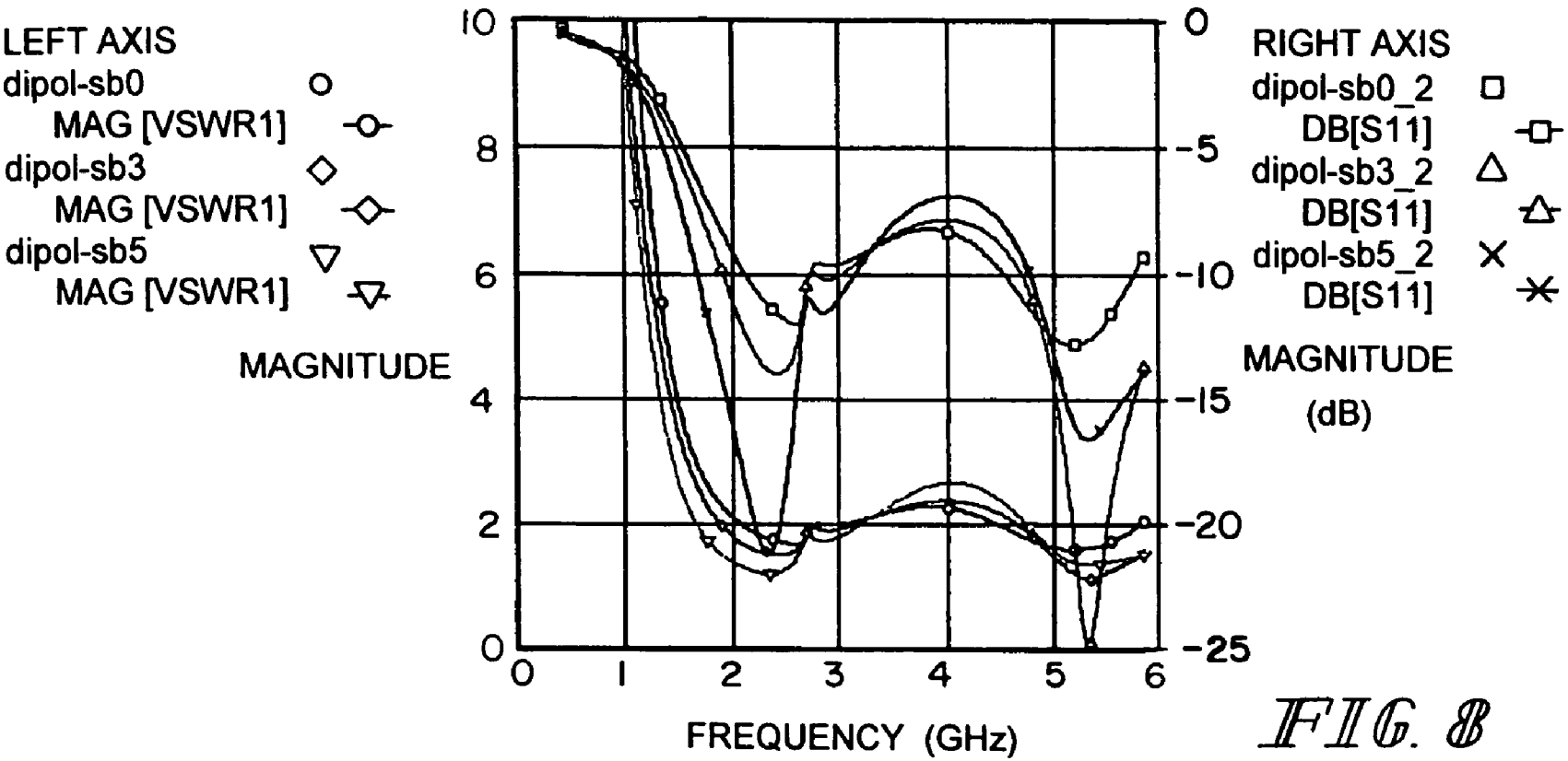
FIG. 8 is a graph showing the effects of changing the width of the slot S of the dipole of FIG. 1.

FIG. 8 shows the effect of changing the slot width S from 1 mm to 3 mm to 5 mm. The 3 mm slot width corresponds to FIG. 6. Although there is not much change in the VSWR, there is substantial change in the S11 magnitude. For example, for the 5 mm strip, S11 is −21 dB at 2.5 GHz and −16 dB at 5.3 GHz. For the 3.3 mm strip, S11 is −14 dB at 2.5 GHz and −25 dB at 5.23 GHz. For the 1 mm strip, S11 is approximately equal to −13 dB at 2.5 GHz and at 5.3 GHz.

Figure 9:
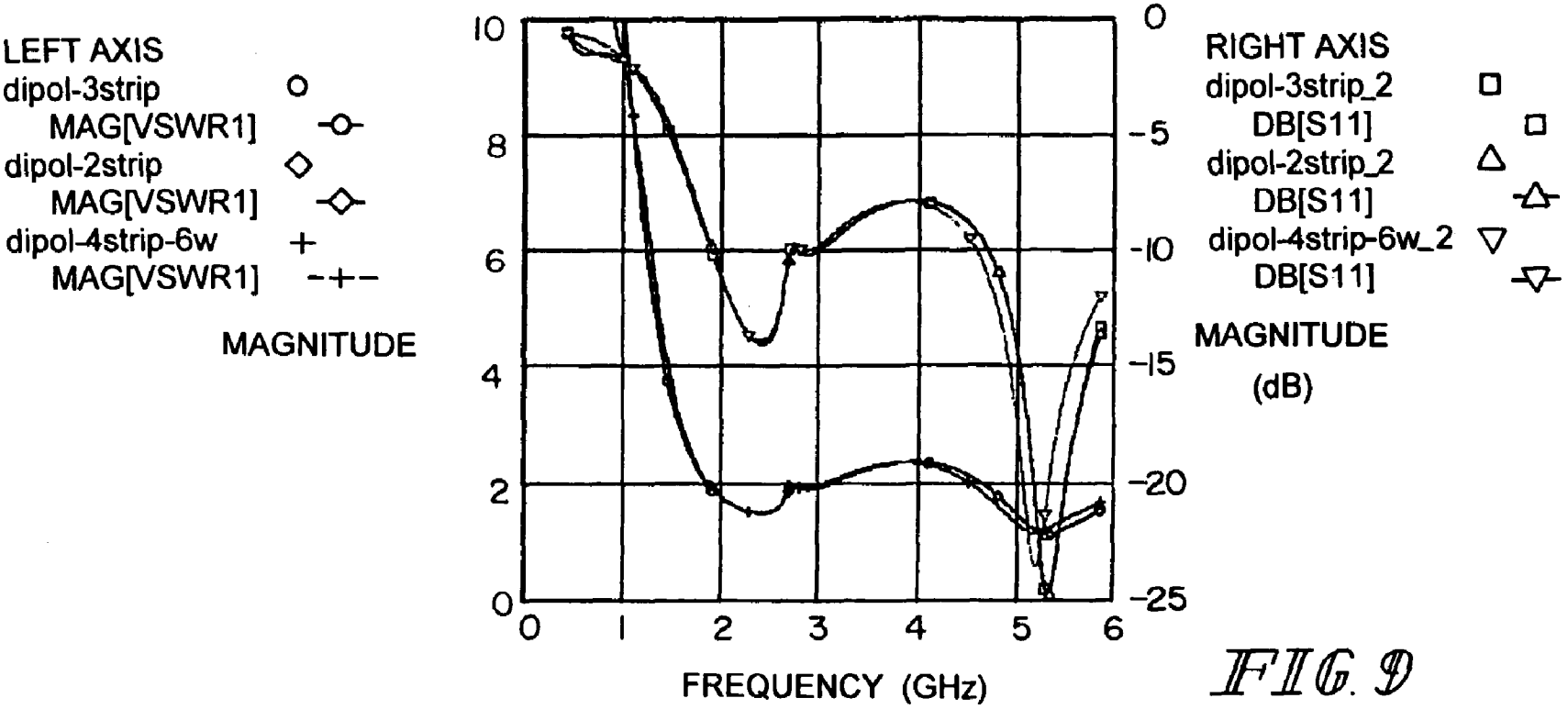
FIG. 9 is a graph showing the effects for a 2-, 3- and 4-strip dipole of FIG. 1.

It should be noted that changing the length of the individual strips 34, 35, 36, 37 between 5 mm, 10 mm and 15 mm has very little effect on VSWR and the S11 magnitude. FIG. 6 corresponds to a 15 mm length. Also, changing the distance between the strips 34, 35, 36, 37 to between 1 mm, 2 mm and 4 mm also has very little effect on VSWR and the S11 magnitude. Two millimeters of separation is reflected in FIG. 6. The difference in magnitude between the 2 mm and the 4 mm spacing was approximately 2 dB. FIG. 9 shows the response of 2-, 3- and 4-dipole strips.

FIGS. 10A and 10B show the effect of changing the width W of the dipole while maintaining the width of the individual strips. The width W of the dipole varies from 6 mm, 8 mm to 10 mm. The 6 mm width corresponds to that of FIG. 6. For the 6 mm width, there are two distinct frequency bands at 2.4 having an S11 magnitude of −14 dB and at 5.3 GHz having an S11 magnitude of −25 dB. For the 8 mm width, there is one large band having a VSWR below two extending from 1.74 to 5.4 GHz and having an S11 magnitude of approximately −20 dB. Similarly, the 10 mm width is one large band at a VSWR below two extending from 1.65 to 5.16 GHz and having an S11 at 2.2 GHz of −34 dB to an S11 at 4.9 GHz of −11 dB.

Figure 7B:
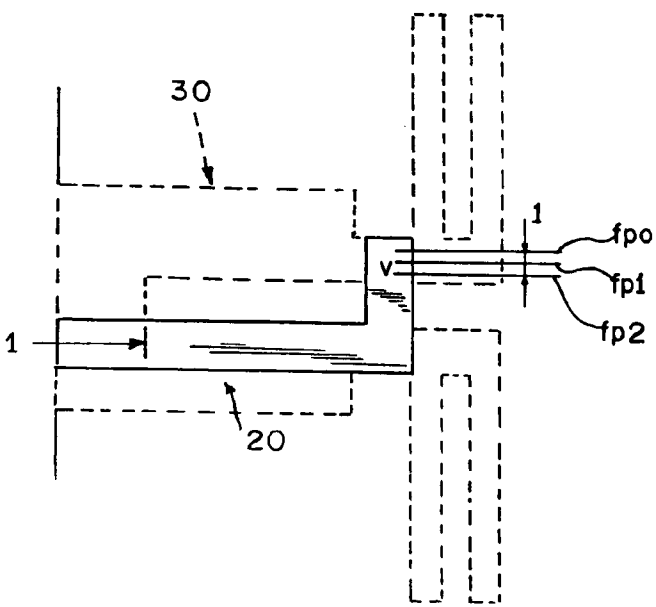

A directional (or unidirectional) dipole antenna incorporating the principles of the present invention is illustrated in FIGS. 7 through 9. Those elements having the same structure, function and purpose as that of the omni-directional antenna of FIG. 1 have the same numbers.

Figure 11:
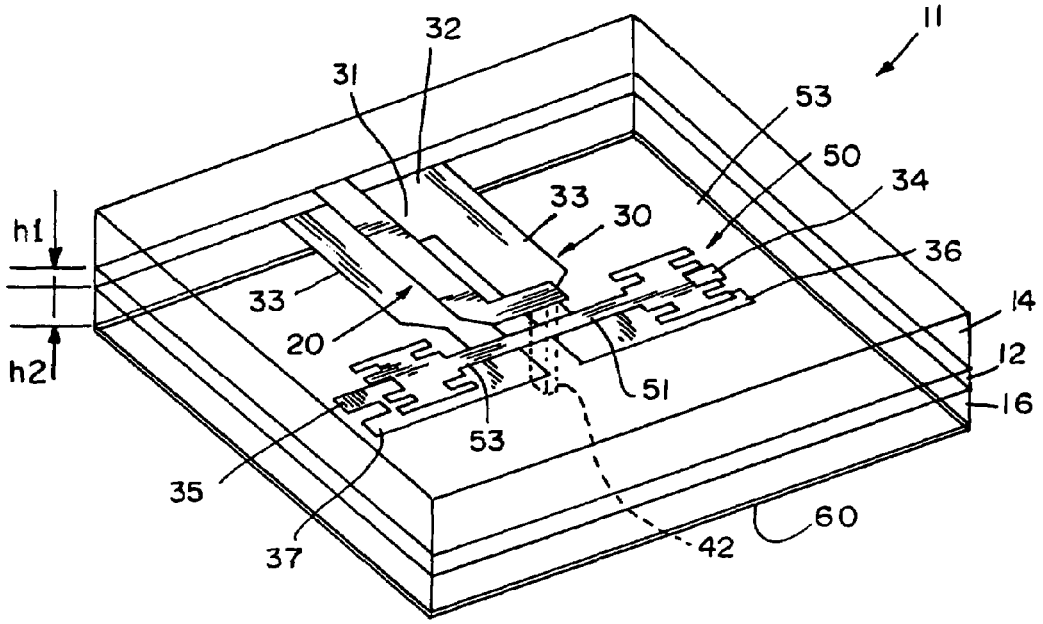
FIG. 11 is a perspective, diagrammatic view of a directional dipole antenna incorporating the principles of the present invention.
Figure 12:
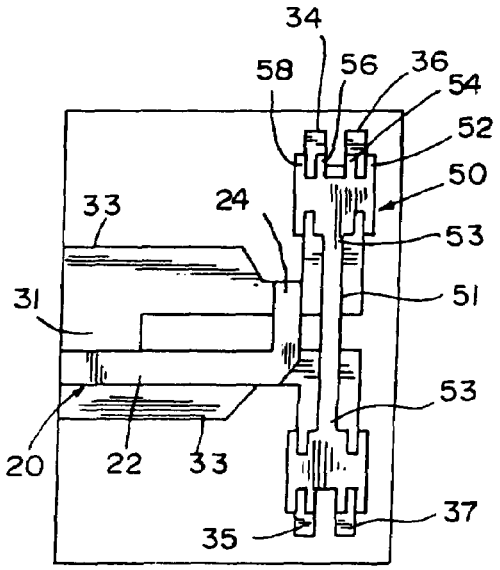
FIG. 12 is a plane top view of the antenna of FIG. 11.
Figure 13:
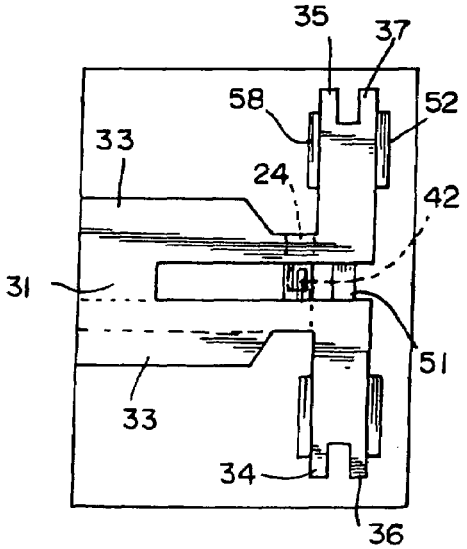
FIG. 13 is a bottom view of the antenna of FIG. 11.

The antenna 11 of FIGS. 11 through 13 includes, in addition to the first conductive layer 20 on a first surface of the dielectric substrate 12 and a second conductive dipole 30 on the opposite surface of the dielectric substrate 12, a ground conductive layer 60 separated from the second conductive layer 30 by the lower dielectric layer 16. Also, a third conductive element 50 is provided on the same surface of the dielectric substrate 12 as the first conductive element 20. The third conductive element 50 is a directive dipole. It includes a center strip 51 having a pair of end portions 53. This is generally a barbell-shaped conductive element. It is superimposed over the strips 34, 36, 35, 37 of the second conductive layer 30. It is connected to the ground layer 60 by a via 42 extending through the dielectric substrate 12 and dielectric layer 16.

The directive dipole 50 includes a plurality of fingers superimposed on a portion of the edges of each of the strips 34, 36, 35, 37. As illustrated, the end strips 52, 58 are superimposed and extend laterally beyond the lateral edges of strips 34, 36, 35, 37. The inner fingers 54, 56 are adjacent to the inner edge of strips 34, 36, 35, 37 and do not extend laterally therebeyond.

Preferably, the permeability or dielectric constant of the dielectric substrate 12 is greater than the permeability or dielectric constant of the dielectric layer 16. Also, the thickness h1 of the dielectric substrate 12 is substantially less than the thickness h2 of the dielectric layer 16. Preferably, the dielectric substrate 12 is at least half of the thickness of the dielectric layer 16.

The polygonal perimeter of the end portion 53 of the dipole directive 50 has a similar shape of the PEAN03 fractal shape directive dipole. It should also be noted that the profile of the antenna 12 gives the appearance of a double planar inverted-F antenna (PIFA).

Figure 14:
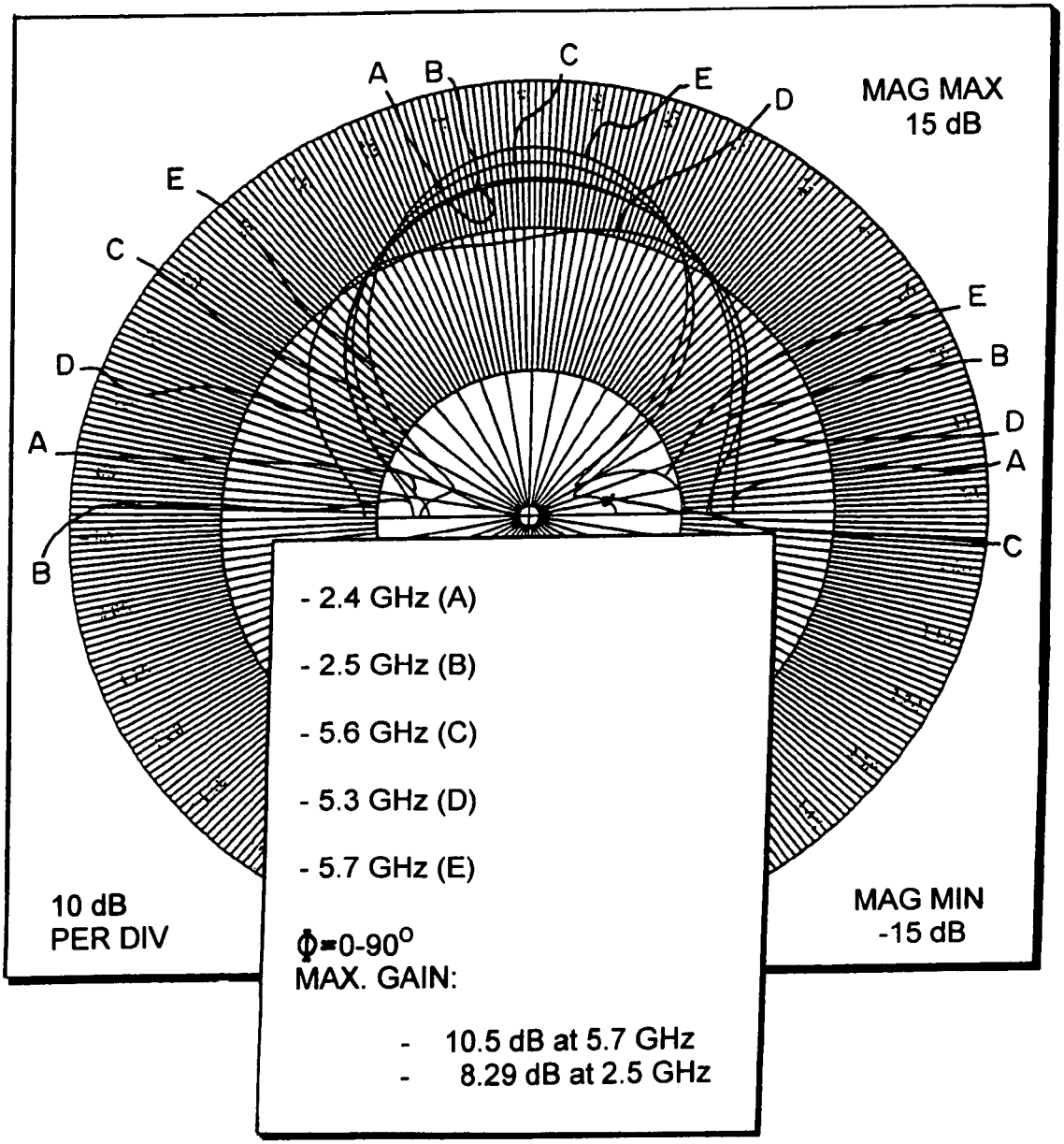
FIG. 14 is a graph of the directional gain of the antenna of FIG. 11 for five frequencies.
Figure 15:
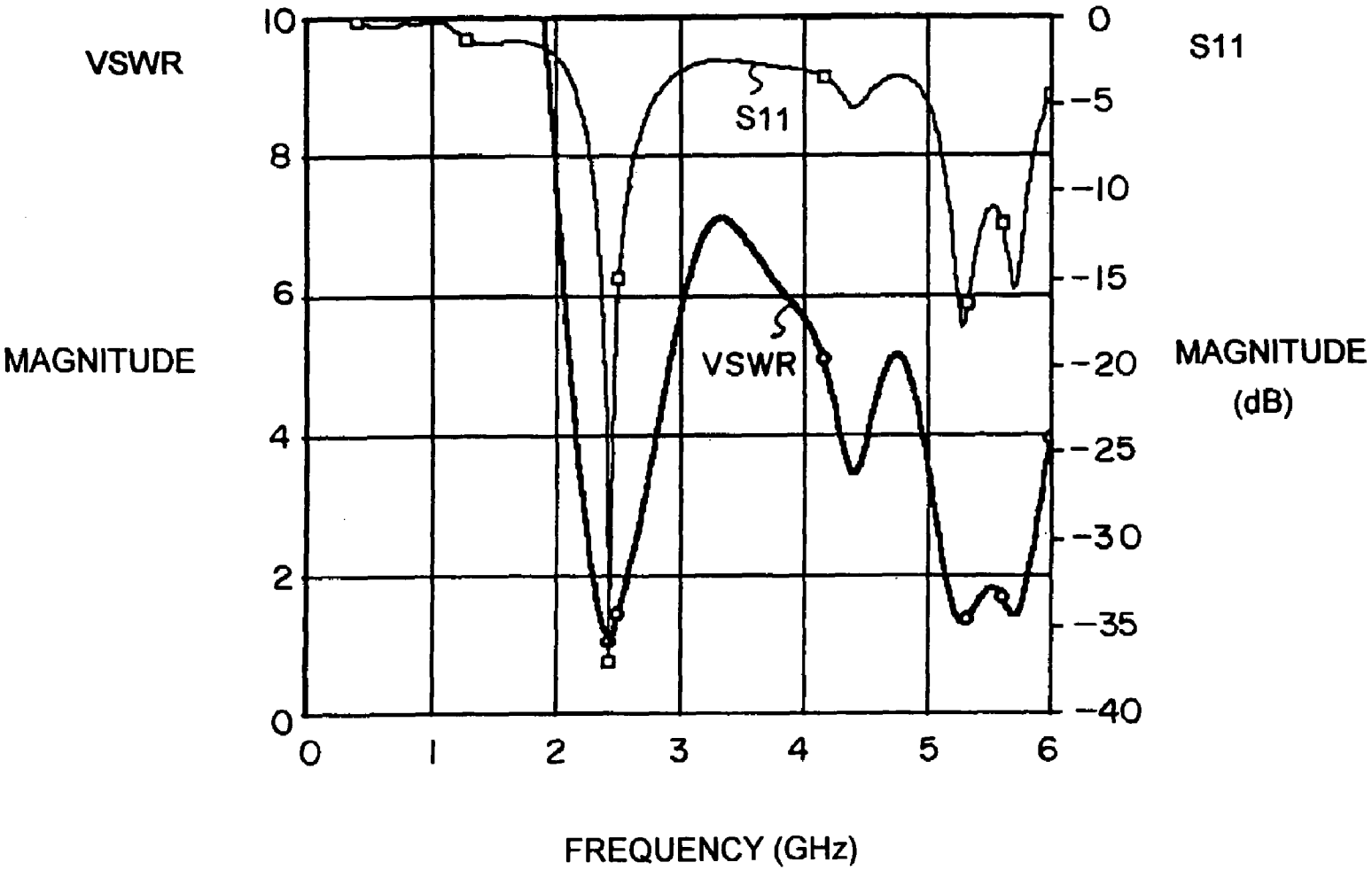
FIG. 15 is a graph of frequency versus VSWR and S11 of the antenna of FIG. 11.

FIG. 14 is a graph of the directional gain of antenna 12, while FIG. 15 shows a graph for the VSWR and the magnitude S11. Five frequencies are illustrated in FIG. 14. The maximum gain are above 7 dB and are 8.29 dB at 2.5 GHz and 10.5 dB at 5.7 GHz. The VSWR in FIG. 15 is for at least two frequency bands that are below 2.

Figure 16A:
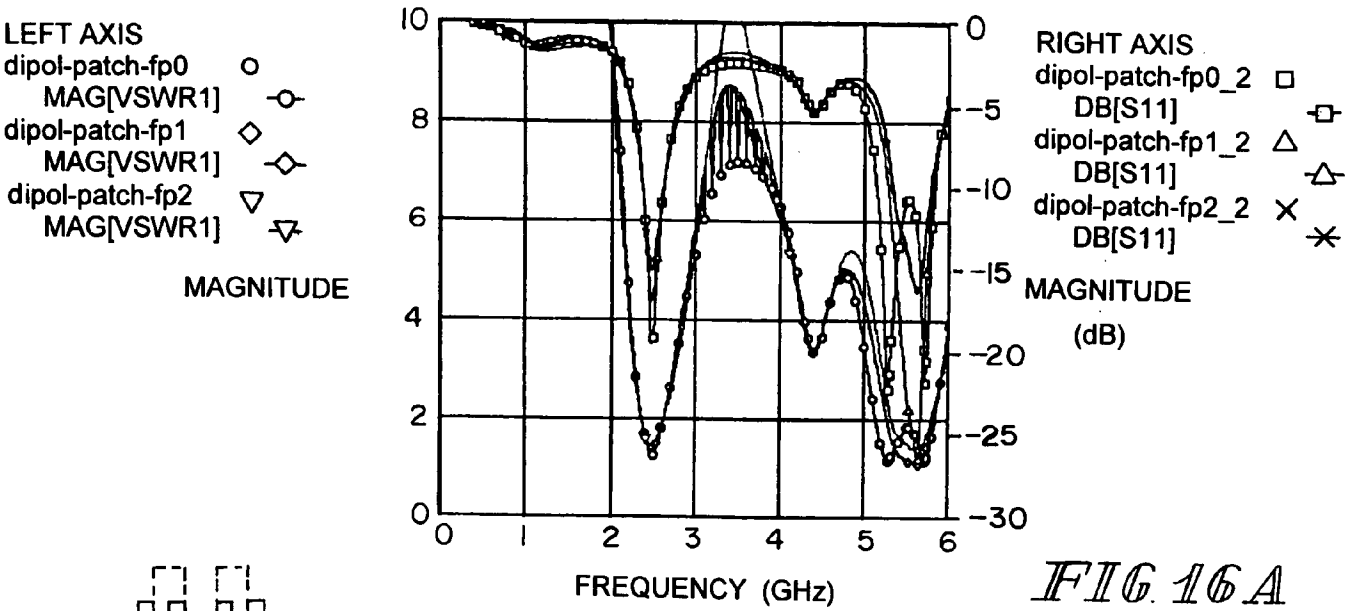
FIG. 16A is a graph showing the effects of changing the feed point or via 40 for the feed positions illustrated in FIG. 16B for the dipole antenna of FIG. 11.
Figure 16B:
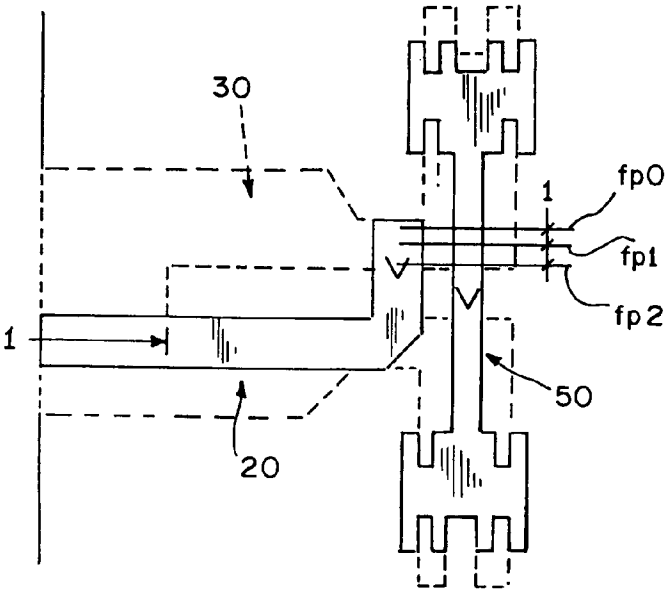
Figure 17:
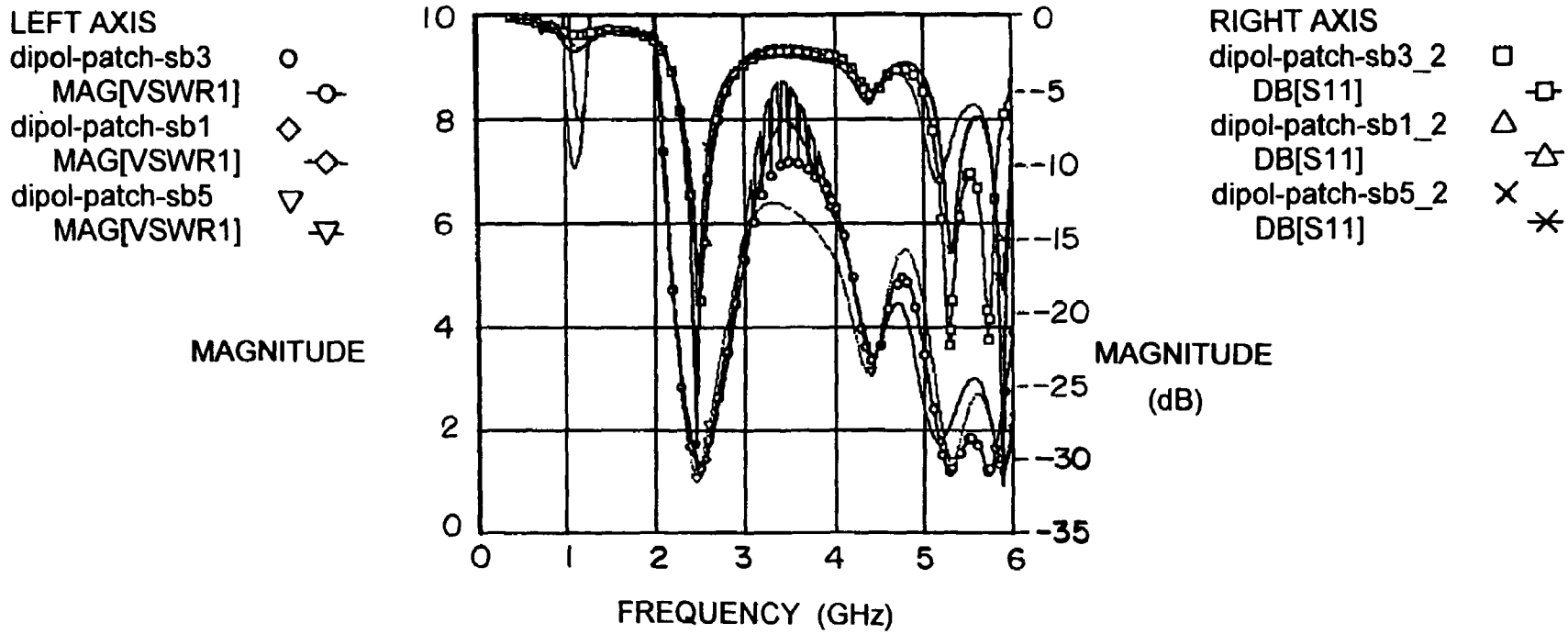
FIG. 17 is a graph showing the effects of changing the width of slot S for the dipole antenna of FIG. 11.
Figure 18A:
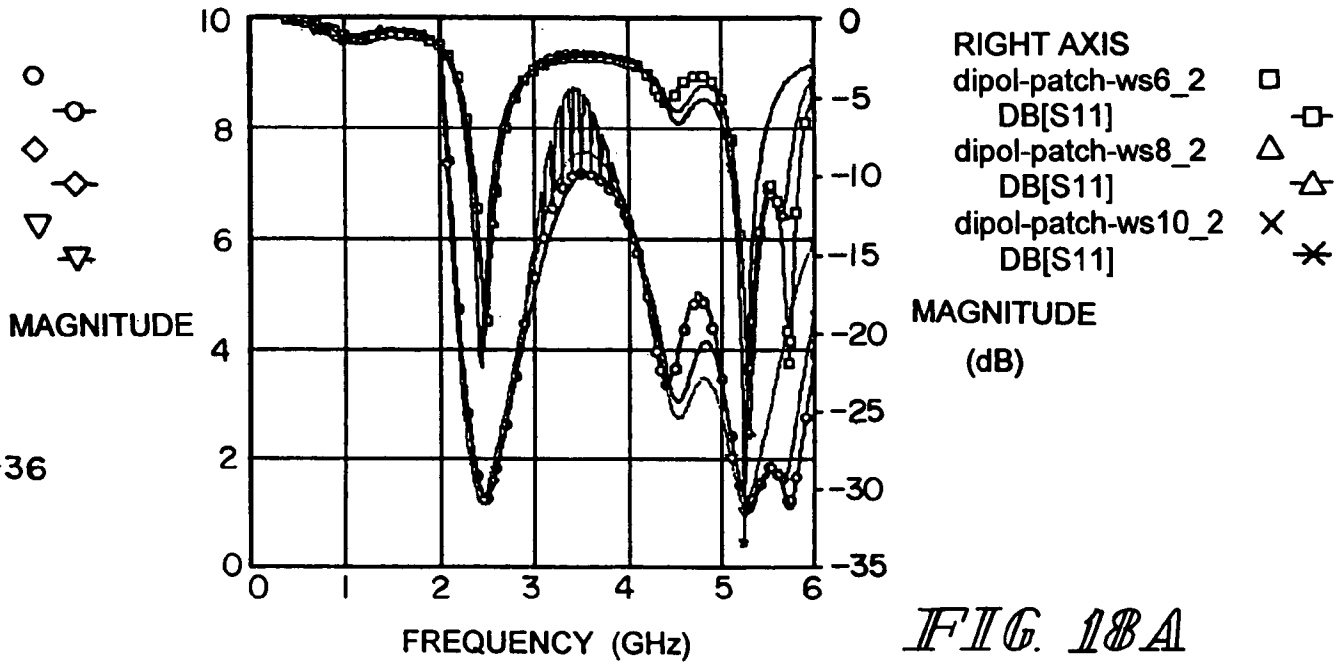
FIG. 18A is a graph showing the effects of changing the width of the dipole, as illustrated in FIG. 18B, of the antenna of FIG. 11.
Figure 18B:
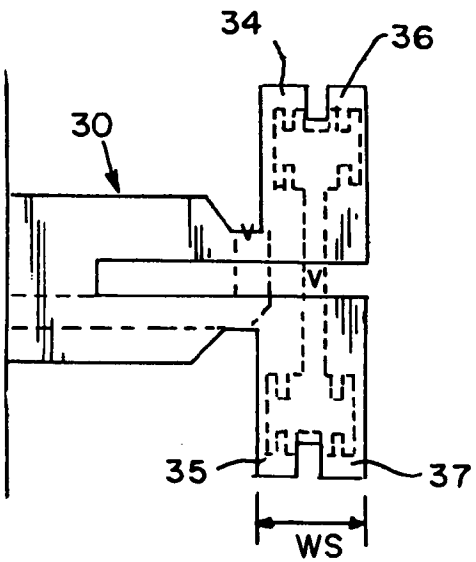
Figure 19A:
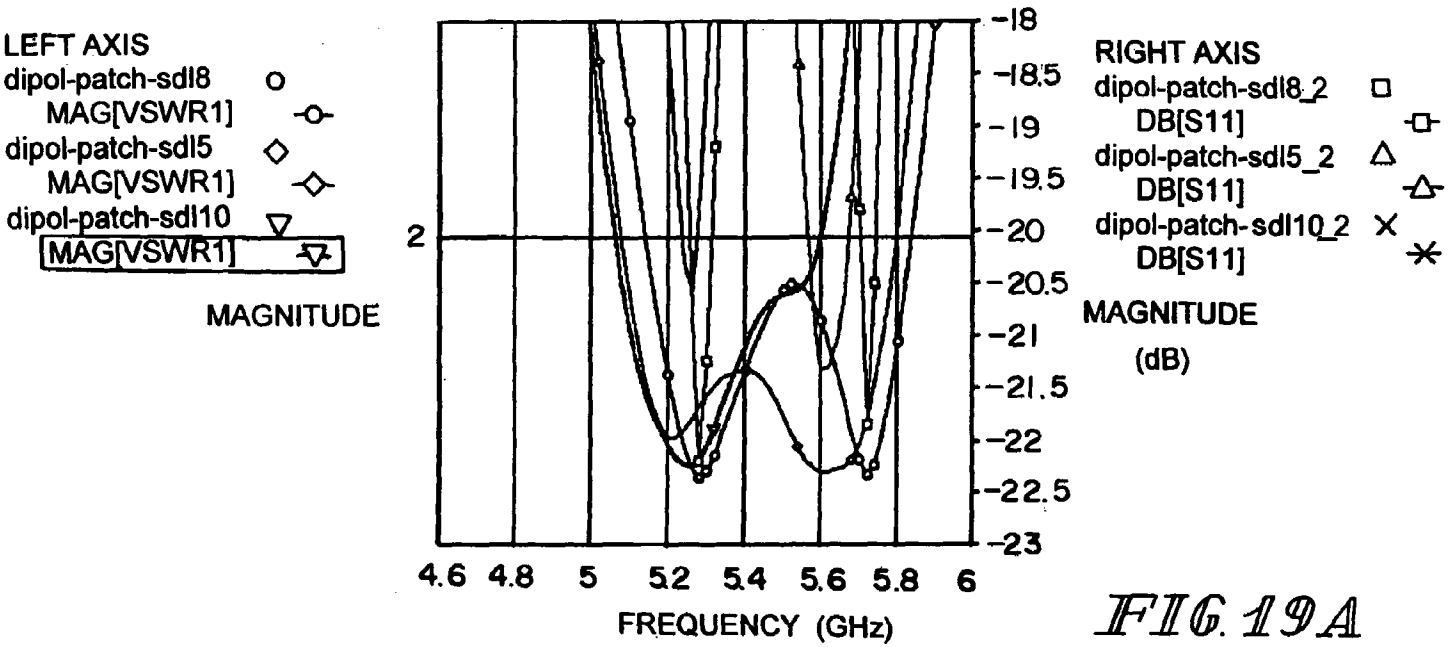
FIG. 19A is a graph of the second frequency showing the effect of changing the length of the directive dipole, as illustrated in FIG. 19B, of the dipole antenna of FIG. 11.
Figure 19B:
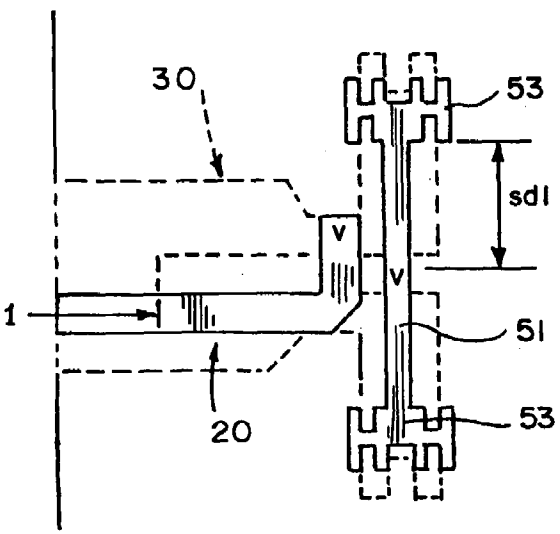

FIGS. 16A and 16B show the effect of the feed point fp or via 40. Feed point zero is similar to that shown in FIG. 15. FIG. 17 shows the effect of the slot width S for 1 mm, 3 mm and 5 mm. The 3 mm width corresponds generally to that of FIG. 15. FIGS. 18A and 18B show the effect of the dipole strip width SW for widths of 6 mm, 8 mm and 10 mm. The 6 mm width corresponds to that of FIG. 15. FIGS. 19A and 19B show the effect of the length SDL of portion 51 of the directive dipole 50 on the second frequency in the 5 GHz range. The 8 mm width corresponds generally to that of FIG. 15.

Figure 20:
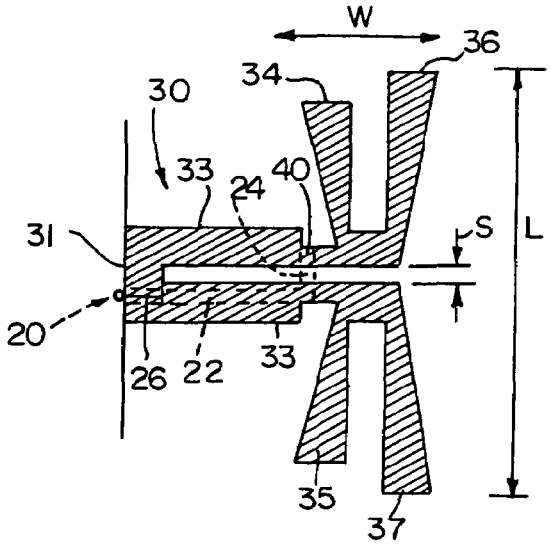
FIG. 20 is a plane view of the dipole conductive layers of another dipole antenna according to the present invention.

Similar to the antenna system 10 of FIGS. 1, 2A and 3, the antennas of FIGS. 20 and 24 include the l-shaped first conductive layer 20, which is a micro-strip line, and the split dipole conductive layer 30 printed on opposite sides of the substrate 12. A conductive via 40 connects the end of leg 24 to one of the legs 33 through the dielectric substrate 12. Terminal 26 at the other end of leg 22 of the first conductive layer 20 receives the drive for the antenna 10.

The plurality of strips 35, 37, 34, 36 on the legs 33 of the split dipole conductive layer 30 are trapezoidal shaped in FIG. 20. The adjacent sides of strips 34/36 and 35/37 are shown as parallel. The strips 34 and 35 are shown as shorter length than strips 36 and 37 The width W may be for example 22 mm and the length L may be 48 to 68 mm.

Figure 23:
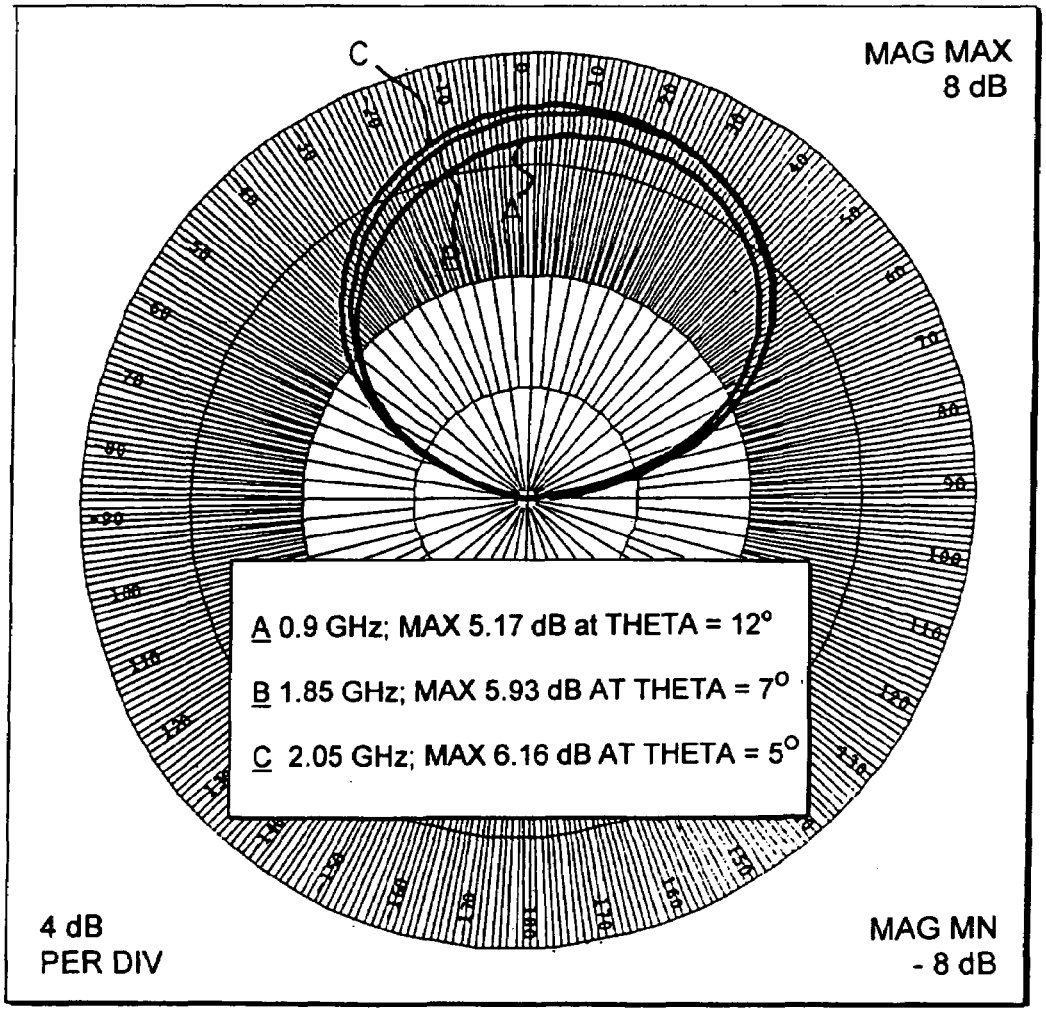
FIG. 23 is a graph of the directional gain of the antenna of FIG. 20 for three frequencies.
Figure 21:
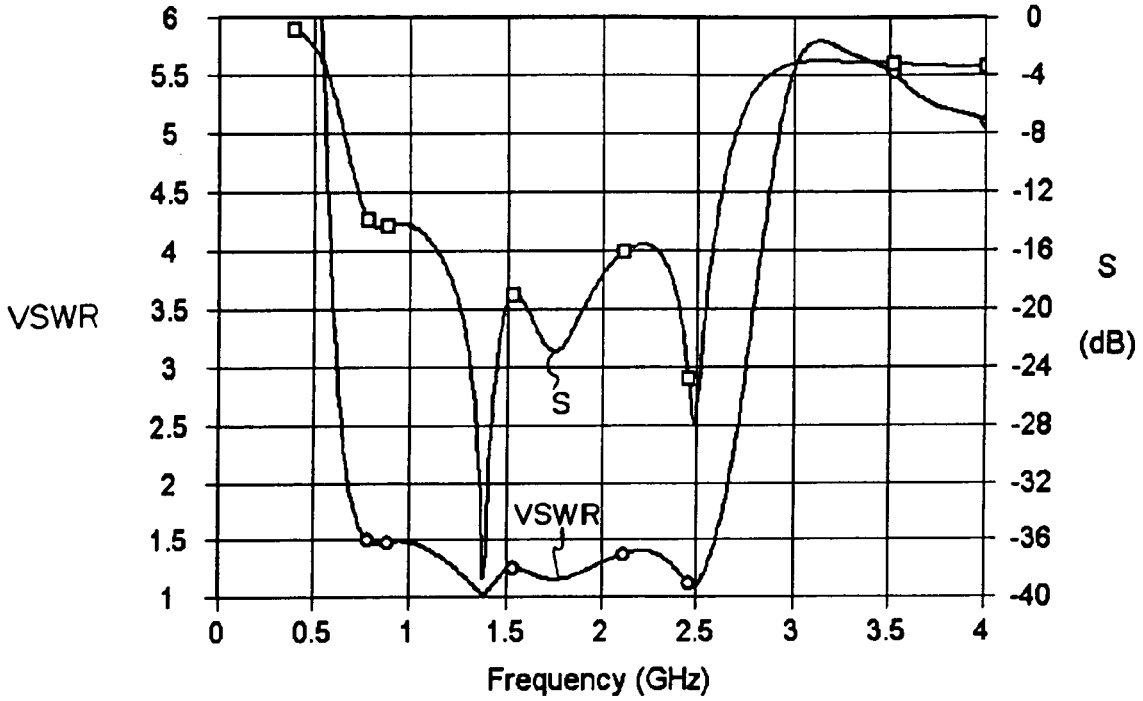
FIG. 21 is a graph of frequency versus VSWR and S11 of the antenna of FIG. 20.
Figure 22:
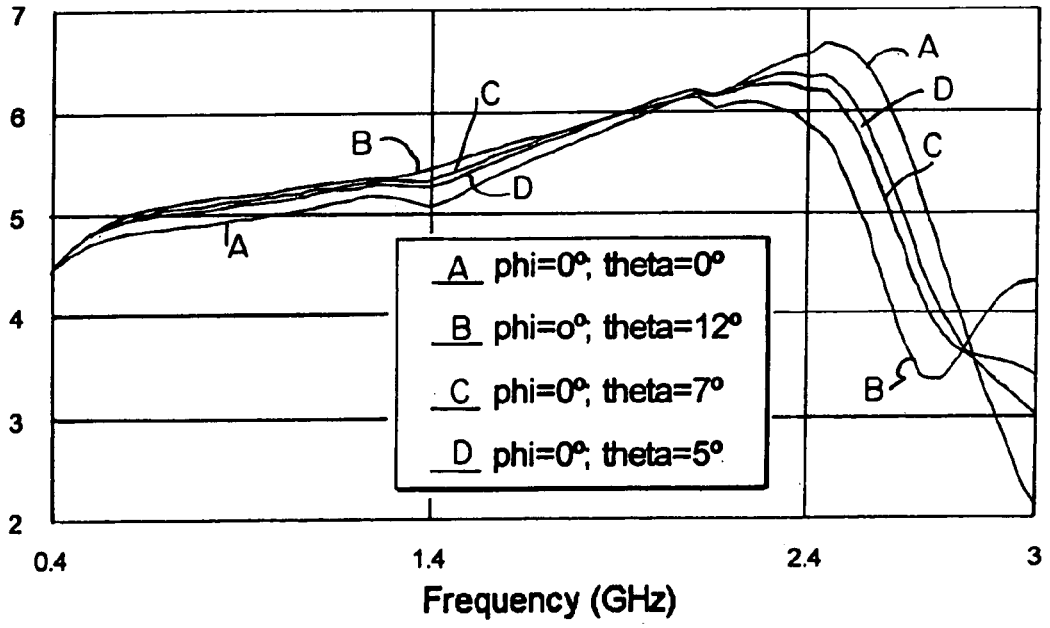
FIG. 22 is a graph of frequency versus directivity for four thetas of the antenna of FIG. 20.

As an example, a dual-band dipole antenna of FIG. 20 would have a width W of 22 mm and a length L of 48 mm. VSWR and the magnitude S11 are illustrated in FIG. 21. VSWR is below 2 between 0.7 GHz to 2.5 GHz. Directivity at phi of zero and four different thetas are shown in FIG. 22. The directional gain is illustrated in FIG. 23 for three frequencies and thetas and a zero degree phi, namely 0.9 GHz, having a maximum gain of 5.17 dB for theta of 12 degree (Graph A), 1.85 GHz having a maximum gain of 5.93 dB for theta 7 degrees (Graph B) and 2.05 GHz having a maximum gain of 6.16 dB for theta 5 degrees.

Figure 24A:
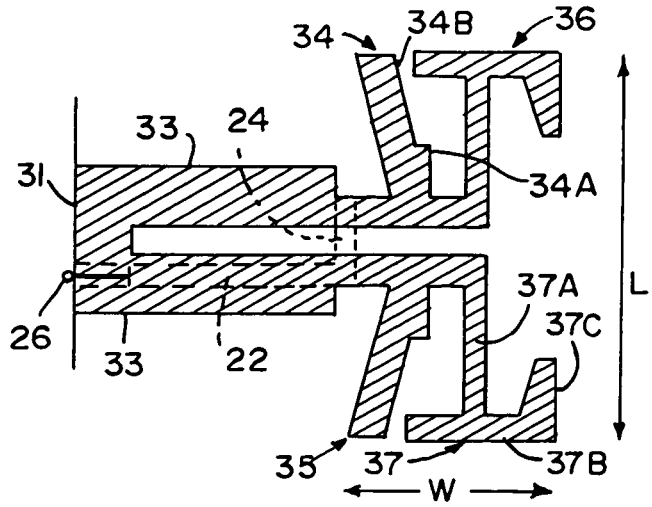
FIGS. 24A, 24B and 24C are plane views of the dipole conductive layers of variations of another dipole antenna according to the present invention.

FIGS. 24A, B and C show a variation of a dual band dipole antenna structure. The structure of strips 34 and 35 are the same, and strips 36 and 37 are the same. By way of example, the strip 34 includes a first portion 34A extending transverse from the leg 33 of the U-shape and having a second end 34B extending transverse to the first portion 34A. Although one face of the first portion 34A is horizontal to the axis of the leg 33, its other face is at a transverse angle and continues into and is co-linear with the second portion 34B. As previously discussed, strip 35 has the same structure. By way of example, the leg 37 is generally T-shaped and includes a base portion 37A, head portion 37B and a third portion 37C extending from one side of the head of the T-shape back towards the leg 33 of the U-shape. This combined structure may also be considered generally shaped as a claw hammer. Portion 37C is on the opposite side of the body 37A from the strip 35. The angle of portion 34B allows the strips 34, 35 to have the same length as the strips 36, 37. The strips 34, 35 generally extend at an acute angle from the legs 33 of the U-shape. This structure gives the desired frequency response while minimizing width W. The length L of the split dipole may be in the range of 35–42 mm, and the width W may be in the range of 10–24 mm.

Figure 24B:
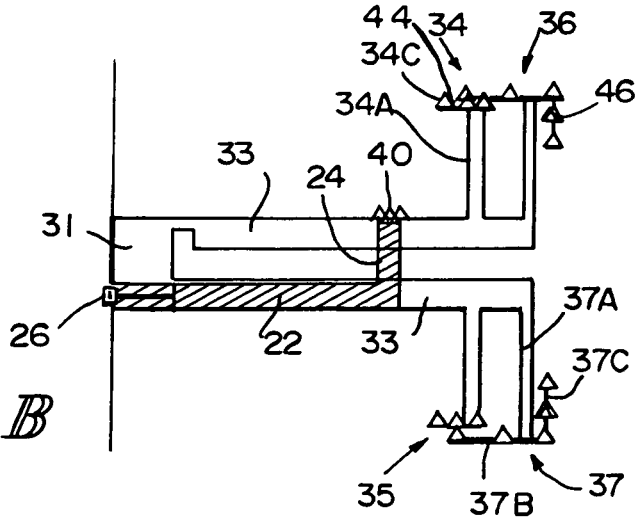

A modification of the antenna of FIG. 24A is illustrated in FIG. 24B. The strips 36, 37 have the generally T-shape, including portions 37A, 37B and 37C. Modifications of the strips 34, 35 are shown. The strip 34 includes a straight portion 35A extending transverse to the leg 33 and includes a head portion 34C forming an inverted L-shape. The length of strip 34 is shorter than that of strip 36. The short leg 34C of strip 34 and the equivalent part of strip 35 extend through the dielectric substrate 12 with vias 44. Similarly, portions 37B and 37C of strip 37 and the equivalent portion of strip 36 also include vias 46 extending through the dielectric substrate 12, as shown in FIG. 24D. The purpose of the design of the antenna in FIGS. 20, 24A, 24B and 24C is to extend the frequency bands to the TV and GSM low bands (400–800 MHz) maintaining or reducing the overall dimensions size of the antenna by folding or extending in Z direction (44, 46 element in FIGS. 24B and 24C) the dipole.

Figure 24C:
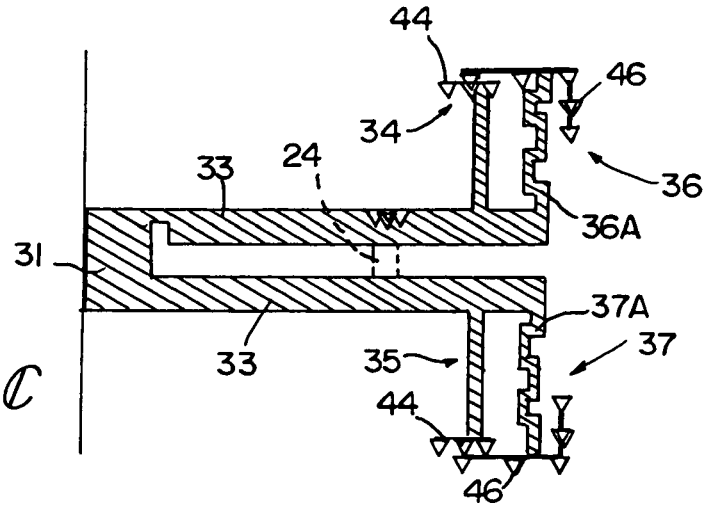

FIG. 24C shows a further modification of the dipole antenna of FIG. 24B. The base portion 37A of strip 37 and the equivalent part of strip 36 are shown as a serpentine pattern. The serpentine pattern in FIG. 24C is a rectangular serpentine pattern as compared to the sinusoidal or triangular serpentine pattern of FIG. 28B, which is discussed below.

Figure 25:
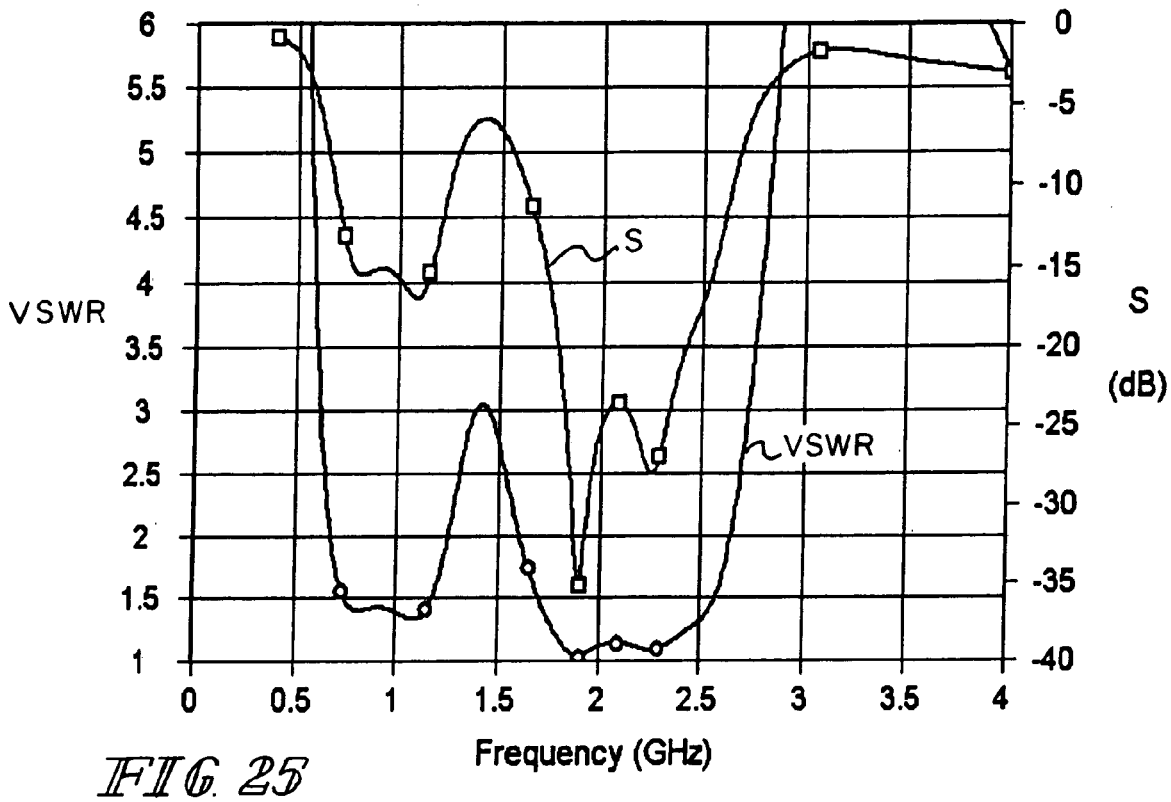
FIG. 25 is a graph of frequency versus VSWR and S11 of the antenna of FIG. 24A.
Figure 26:
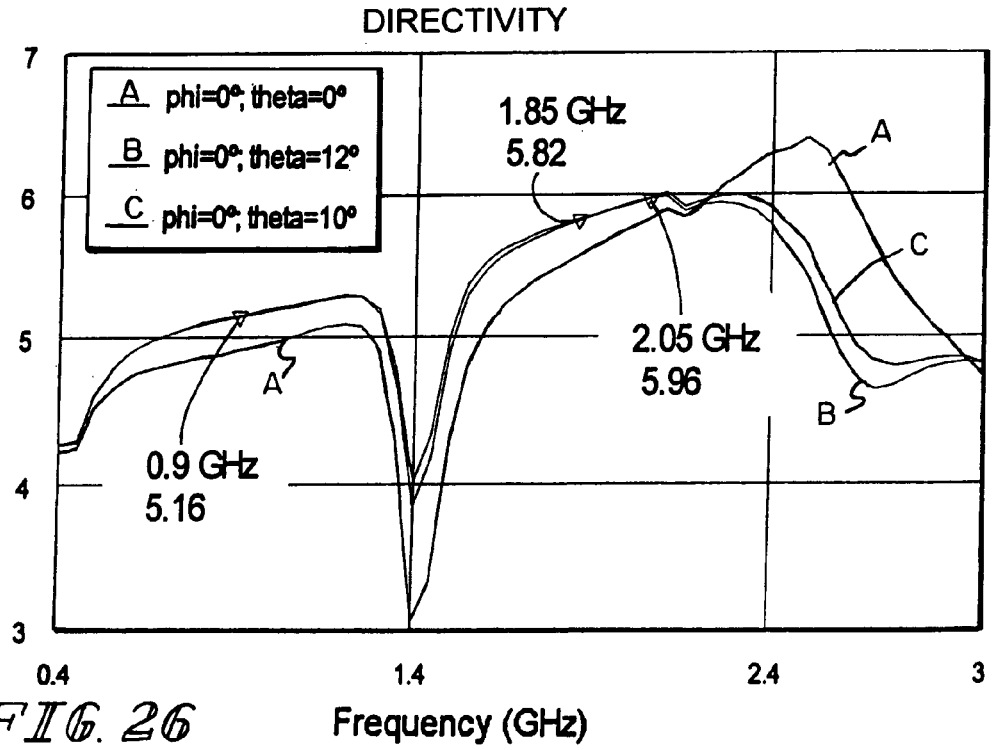
FIG. 26 is a graph of frequency versus directivity for three thetas of the antenna of FIG. 24A.
Figure 27:
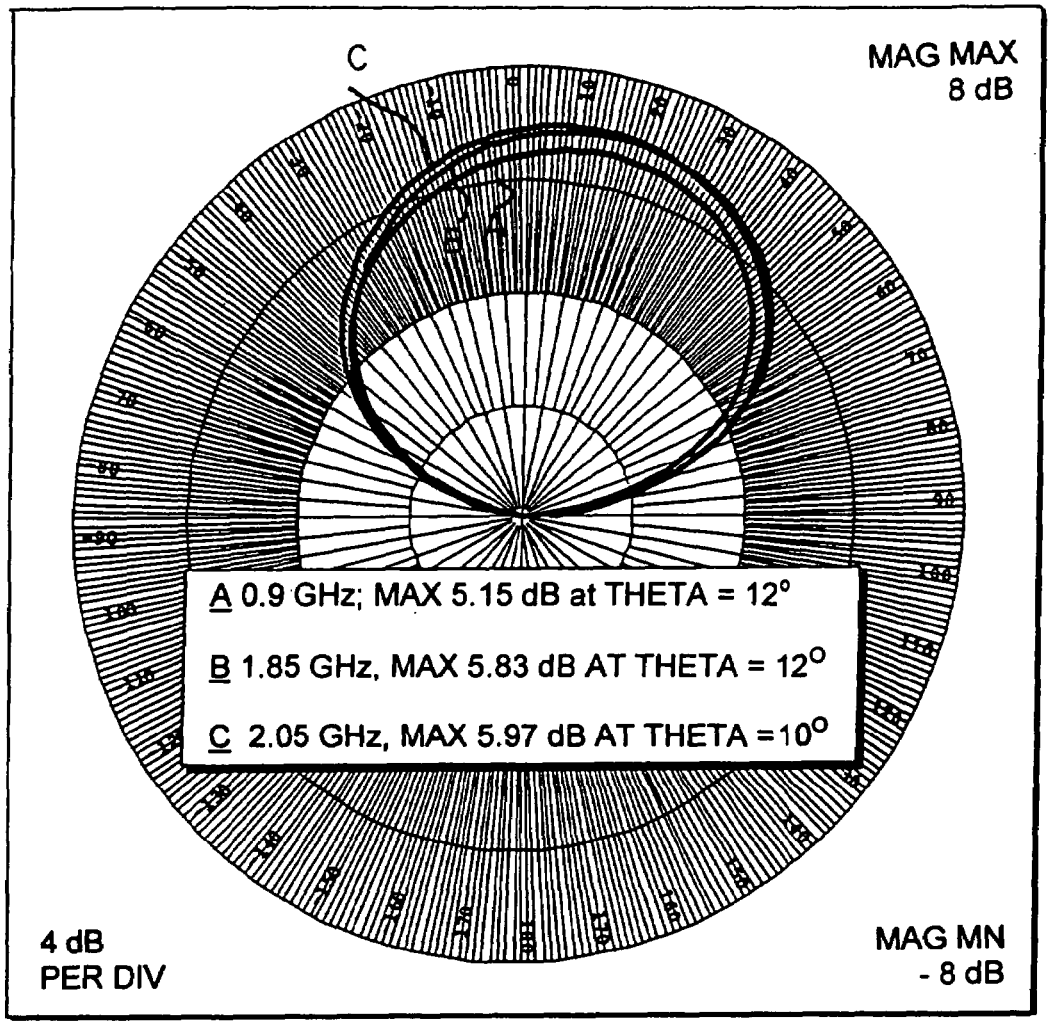
FIG. 27 is a graph of the directional gain of the antenna of FIG. 24A for three frequencies.

As an example, a dual-band dipole antenna of FIG. 24A would have a width W of 22 mm and a length L of 40 mm. VSWR and the magnitude S11 are illustrated in FIG. 25. VSWR is below 2 between 0.7 to 1.2 GHZ and 1.6 to 2.5 GHz. Directivity at phi of zero and three different thetas zero degree (Graph A), 12 degree (Graph B), 7 degree (Graph C) and 5 degree (Graph D) are shown in FIG. 26. The directional gain is illustrated in FIG. 27 for three frequencies and thetas and a zero degree phi, namely 0.9 GHz, having a maximum gain of 5.15 dB for theta of 12 degrees (Graph A), 1.85 GHz having a maximum gain of 5.83 dB for theta 12 degrees (Graph B) and 2.05 GHz having a maximum gain of 5.97 dB for theta 10 degrees.

A printed dipole antenna powered by a coaxial cable is illustrated in FIGS. 28A–D. The structure of FIG. 28A generally corresponds to that of FIG. 24C, except for the coaxial cable feed. The coaxial feed 60 includes one of the lines 62 connected to one of the legs 33, including strips 34, 36, and a second line 64 connected to the U-shape 33 having strips 35, 37. The length L of the split dipole structure is in the range of 35–44 mm, and the width W is in the range of 10–25 mm. Since this is a coaxial feed, there is no first layer 20. There is only a second conductive layer 30.

Figure 28A:
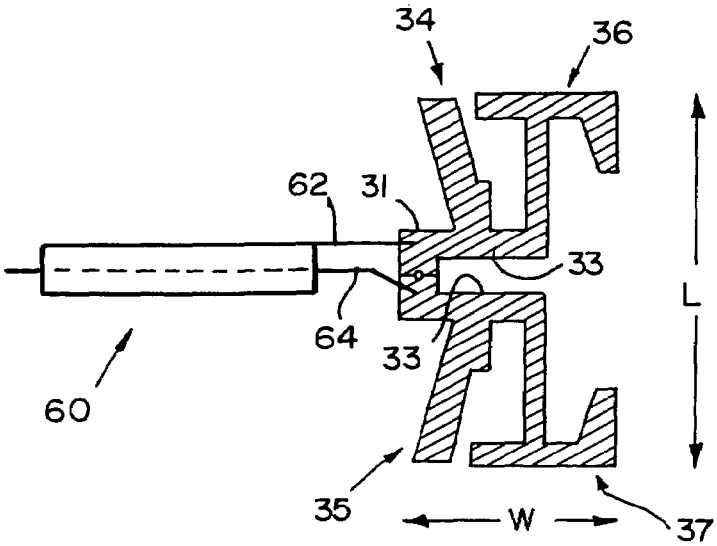
FIGS. 28A, 28B, 28C and 28D are plane views of the dipole conductive layers of variations of another dipole antenna with a coaxial feed according to the present invention.
Figure 28B:
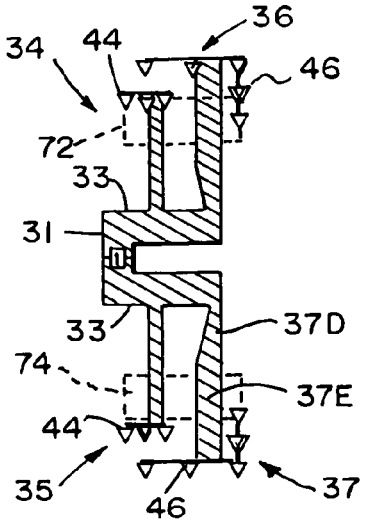
Figure 28C:
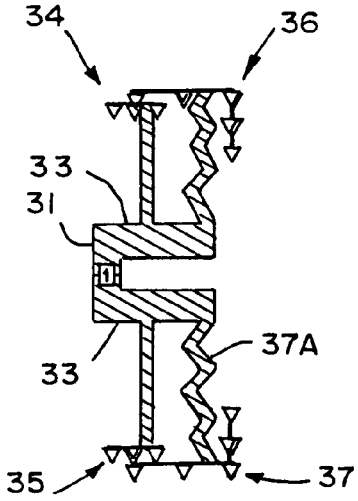

FIGS. 28B and 28C show the structure of the antenna for coaxial feed corresponding to FIGS. 24B and 24C. One of the modifications is that strip's 37 base portion 37A and the corresponding portion of strip 36 include a trapezoidal portion 34D connected to leg 33 and a uniform width portion 37E extending therefrom to the head portion 37B. As mentioned previously, the serpentine pattern 37A and corresponding portion of strip 36 is illustrated in FIG. 28C. This serpentine pattern may be curved and, therefore, sinusoidal, or it may be triangular or a saw tooth wave shape.

Figure 28D:
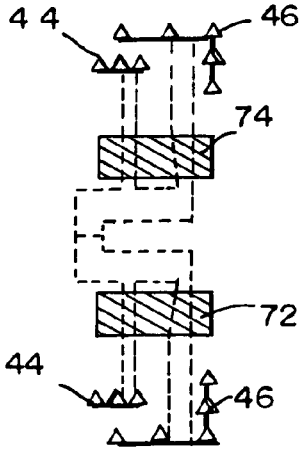

The antenna of FIGS. 28B and 28D show conductive plates 72, 74 juxtaposed portions of the strips 34/36 and 35/37, respectively, and separated therefrom by the dielectric substrate 12 (not shown). The conductive plates 72, 74 are on the opposed face of the dielectric substrate 12 replacing the first conductive layer 20. Since this is a coaxial feed, there is no first conductive layer 20. The position of plates 72, 74 along the length of their respective strips 34/36 and 35/37 allows for adjustment of the response of the dipole antenna. It should be noted that the conductive vias 44, 46 which extend through the dielectric substrate 12 do not contact the conductive plates 72, 74.

The conductive plates 72, 74 can be used for all of the antennas described herein. They can be an adhesive metal band or strip attached at different fixed positions. The designed frequencies band can be changed in the range of approximately +/−500 MHz, as a function of the position of the conductive patch. This position is selected by the user when he or she performed the S11 or VSWR experimental measurements. Also, these plates 72, 74 can be a movable conductive (metal) strip moved by a mechanism attached to the antenna or to the antenna box and, in this case, is a sort of mechanic adaptive antenna. The plates 72, 74 can be located on the side with the dipole strip 34/36, 35/37 or in the opposite side, the difference between these locations is in the percent of frequency change (greatest in the case of the side with the dipoles).

Figure 29:
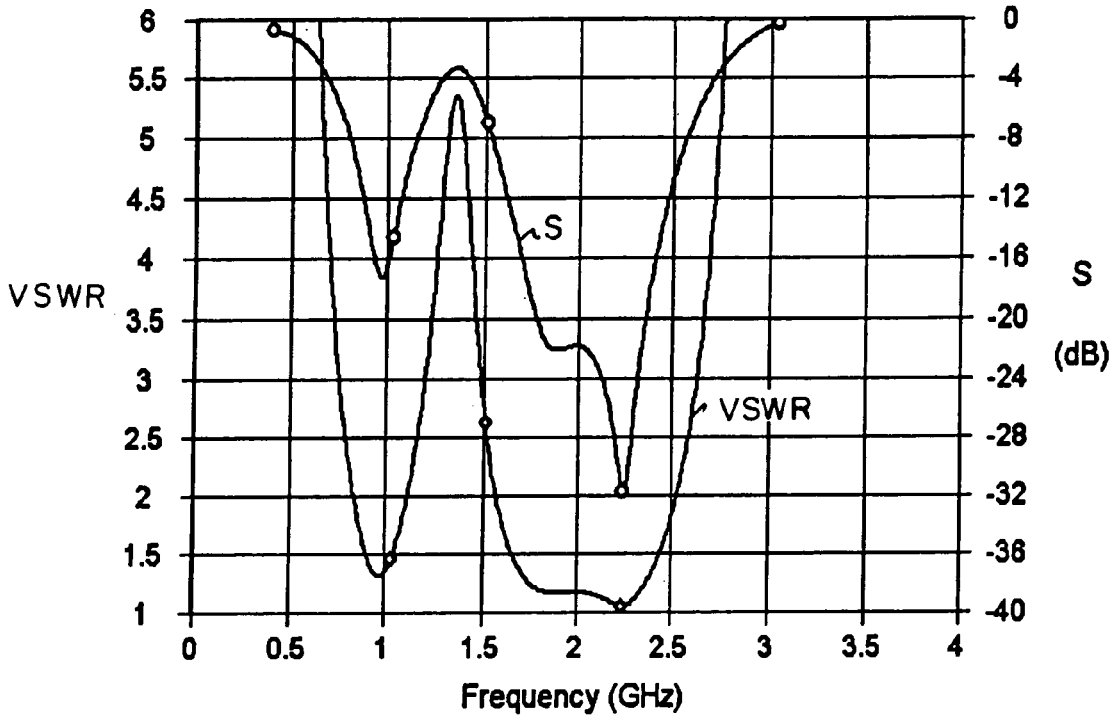
FIG. 29 is a graph of frequency versus VSWR and S11 of the antenna of FIG. 28A.
Figure 30:
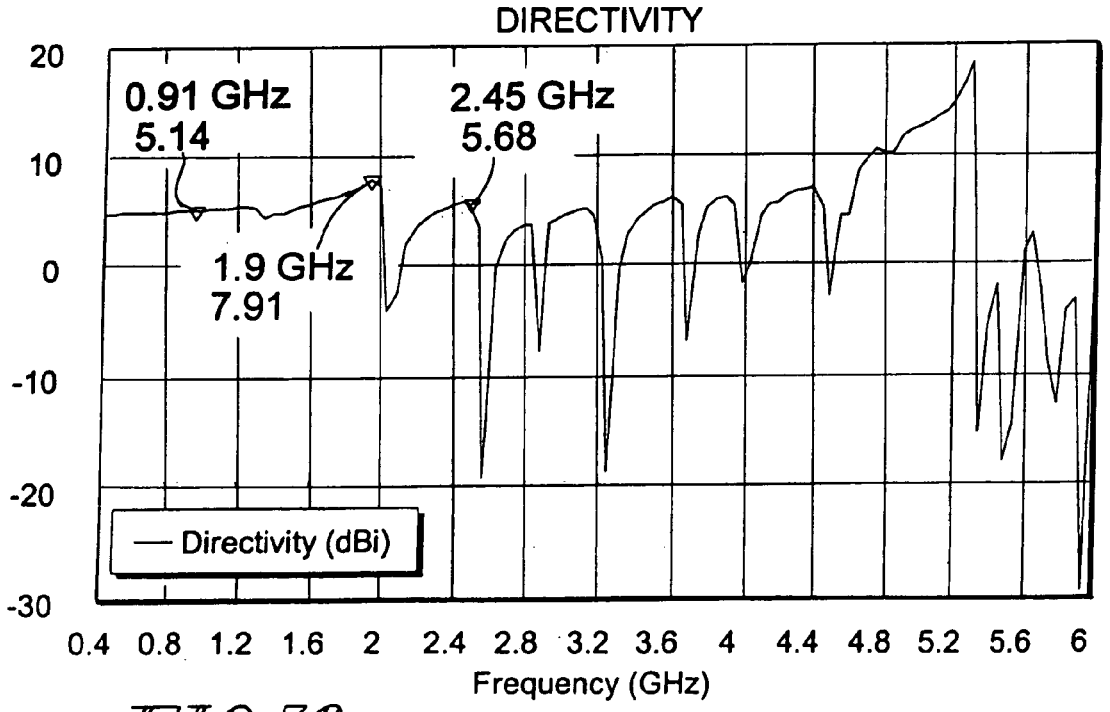
FIG. 30 is a graph of frequency versus directivity for one theta of the antenna of FIG. 28A.
Figure 31:
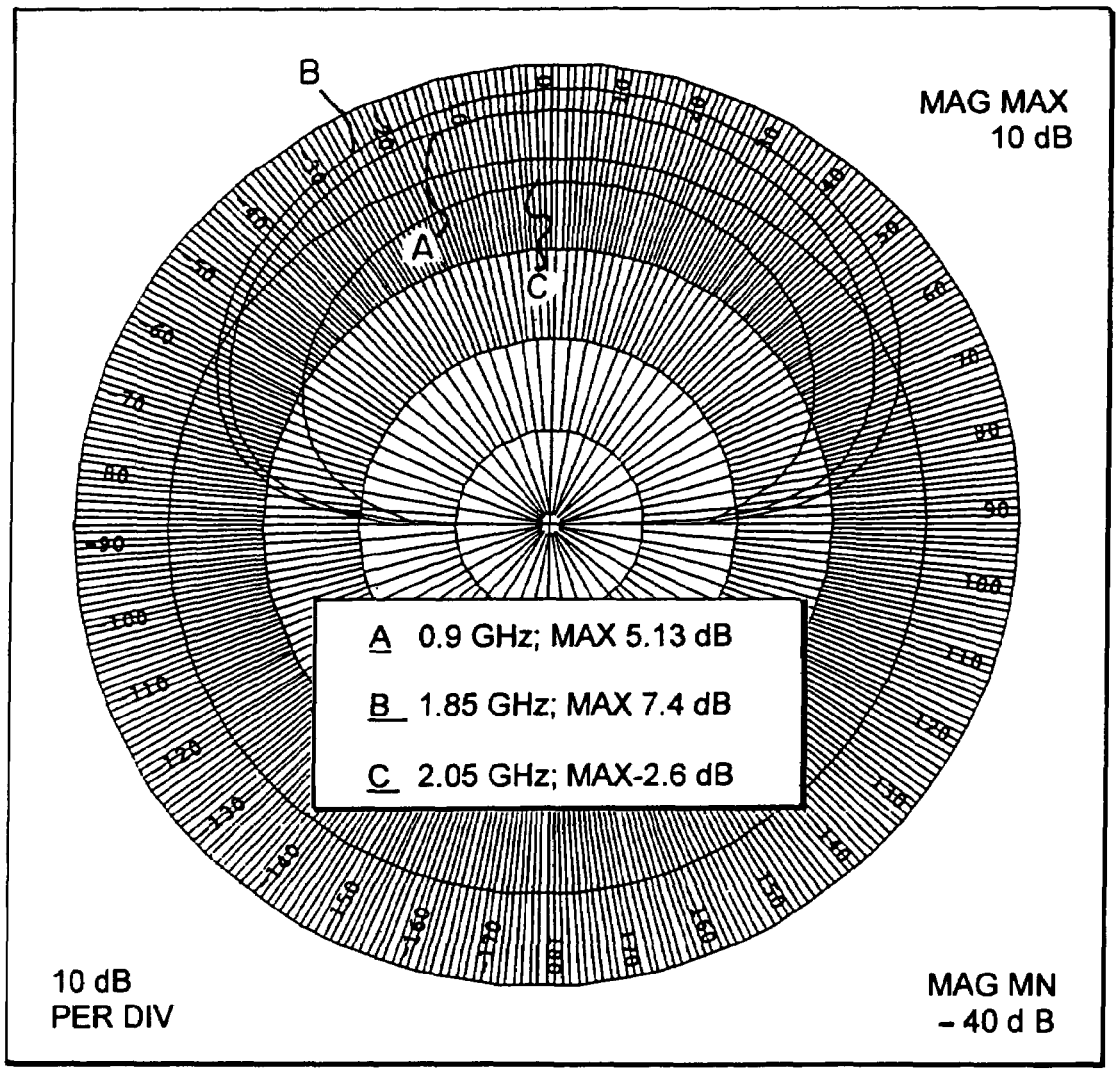
FIG. 31 is a graph of the directional gain of the antenna of FIG. 28A for three frequencies.

As an example, a dual-band dipole antenna of FIG. 28A would have a width W of 25 mm and a length L of 40 mm. VSWR and the magnitude S11 are illustrated in FIG. 29. VSWR is below 2 between 0.85 to 1.1 GHZ and 1.6 to 2.5 GHz. Directivity at phi of zero degrees and thetas of zero degrees is shown in FIG. 30. The directional gain is illustrated in FIG. 31 for three frequencies and a zero degree theta and phi, namely 0.9 GHz, having a maximum gain of 5.13 dB (Graph A), 1.85 GHz having a maximum gain of 7.4 dB (Graph B) and 2.05 GHz having a maximum gain of −2.05 dB.

Although not shown, a number of via holes around the dipole through the insulated layer 12 may be provided. These via holes would provide pseudo-photonic crystals. This would increase the total gain by reducing the surface waves and the radiation in the dielectric material. This is true of both antennas.

Although the present disclosure has been described and illustrated in detail, it is to be clearly understood that this is done by way of illustration and example only and is not to be taken by way of limitation. The scope of the present disclosure is to be limited only by the terms of the appended claims.

What is claimed:

1. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

at least one of the strips on each leg being T-shape;

each strip extending from a leg being dimensioned for a different λo than another strip of the leg;

a ground plane conductor superimposed and separated from the second conductive element by a second dielectric layer;

a third conductive element superimposed and separated from the strips of the second conductive element by the first dielectric layer; and a second conductive via connecting the third conductive element to the ground conductor through the dielectric layers.

2. The antenna according to claim 1, wherein the first conductive element is L-shaped.

3. The antenna according to claim 2, wherein one of the legs of the L-shape is superimposed one of the legs of the U-shape.

4. The antenna according to claim 3, wherein the first conductive via connects the other leg of the L-shape to the other leg of the U-shape.

5. The antenna according to claim 2, wherein the first conductive via connects an end of one of the legs of the L-shape to one of the legs of the U-shape.

6. The antenna according to claim 1, wherein the first and second conductive elements are each planar.

7. The antenna according to claim 1, wherein each strip has a width less than 0.05 λo and a length of less than 0.5 λo.

8. The antenna according to claim 1, wherein the first and third conductive elements are co-planar.

9. The antenna according to claim 1, wherein the third conductive element includes a plurality of fingers superimposed a portion of lateral edges of each of the strips.

10. The antenna according to claim 1, wherein a first and last finger superimposed a first and last strip on each leg of the U-shape extend laterally beyond the lateral edges of the respective strips.

11. The antenna according to claim 1, wherein the permeability of the first dielectric layer is substantially greater than the permeability of the second dielectric layer.

12. The antenna according to claim 11, wherein the thickness of the first dielectric layer is substantially less than the thickness of the second dielectric layer.

13. The antenna according to claim 1, wherein the thickness of the first dielectric layer is at least half the thickness of the second dielectric layer.

14. The antenna according to claim 1, wherein the first dielectric layer is a substrate, and the first and second conductive elements are printed elements on the substrate.

15. The antenna according to claim 1, wherein the plurality of strips are parallel to each other.

16. The antenna according to claim 1, wherein at least one of the strips is generally shaped as a claw hammer.

17. A wireless communication device including the antenna of claim 1.

18. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

each strip extending from a leg being dimensioned for a different γo than another strip of the leg; and a pair of conductive plates, each adjacent the strips of a leg of the U-shape at a pre-selected position.

19. The antenna according to claim 18, wherein the conductive plates position is adjustable.

20. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

one of the strips on each leg being T-shape;

one of strips on each leg including a trapezoidal shaped portion and a uniform width portion extending from the trapezoid shaped portion; and each strip extending from a leg being dimensioned for a different λo than another strip of the leg.

21. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

one of the strips on each leg being T-shape;

one of the strips on each leg being adjacent the T-shaped strip and including a portion at an acute angle so as to be spaced adjacent the head of the T-shaped; and each strip extending from a leg being dimensioned for a different λo than another strip of the leg.

22. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

one of the strips on each leg is T-shape having a base and a head;

one of the strips on each leg being adjacent the T-shaped strip, having an inverted L-shape, having a shorter length than the length of the base of the T-shaped strip, and extending from the leg of the U-shape below the head of the T-shaped strip; and each strip extending from a leg being dimensioned for a different λo than another strip of the leg.

23. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

at least one of the strips on each leg being T-shape which includes a portion extending from one side of the head of the T-shape back towards the leg of the U-shape; and each strip extending from a leg being dimensioned for a different λo than another strip of the leg.

24. A dipole antenna for a wireless communication device comprising:

a first conductive element superimposed a portion of and separated from a second conductive element by a first dielectric layer;

a first conductive via connects the first and second conductive elements through the first dielectric layer;

the second conductive element being generally U-shaped;

the second conductive element including a plurality of spaced conductive strips extending transverse from adjacent ends of the legs of the U-shape;

each strip extending from a leg being dimensioned for a different λo than another strip of the leg; and at least one of the strips including a first portion extending transverse to the leg of the U-shape, and a second portion extending transverse to the first portion and a third portion extending into the first dielectric layer from the second portion.

25. A dipole antenna for a wireless communication device comprising:

a generally U-shaped first conductive element on a first dielectric layer;

the first conductive element including a plurality of spaced conductive strips extending transverse from adjacent ends of the legs of the U-shape;

one of the strips on each leg being T-shaped;

one the of strips on each leg having a trapezoidal shaped portion and a uniform width portion extending from the step shaped portion;

each strip extending from a leg being dimensioned for a different λo than another strip of the leg; and a coaxial feed having inner and outer conductors, each connected to a leg of the U-shape.

26. The antenna according to claim 25, wherein the first dielectric layer is a substrate, and the first conductive element is printed on the substrate.

27. The antenna according to claim 25, wherein the plurality of strips are parallel to each other.

28. The antenna according to claim 25, wherein at least one of the strips is generally shaped as a claw hammer.

29. The antenna according to claim 25, including a second conductive element having first and second portions each superimposed the strips extending from one of the legs of the U-shape and separated there from by the first conductive layer.

30. A wireless communication device including the antenna of claim 25.

31. A dipole antenna for a wireless communication device comprising:

a generally U-shaped first conductive element on a first dielectric layer;

the first conductive element including a plurality of spaced conductive strips extending transverse from adjacent ends of the legs of the U-shape;

one of the strips on each leg being T-shaped;

one of the strips on each leg being adjacent the T-shaped strip and including a portion at an acute angle so as to be spaced adjacent the head of the T-shaped;

each strip extending from a leg being dimensioned for a different λo than another strip of the leg; and a coaxial feed having inner and outer conductors, each connected to a leg of the U-shape.

32. A dipole antenna for a wireless communication device comprising:

a generally U-shaped first conductive element on a first dielectric layer;

the first conductive element including a plurality of spaced conductive strips extending transverse from adjacent ends of the legs of the U-shape;

one of the strips on each leg being T-shaped and having a base and a head;

one of the strips on each leg adjacent the T-shaped strip being an inverted L-shape, having a shorter length than the length of the base of the T-shaped strip, and extending from the leg of the U-shape below the head of the T-shaped strip; and each strip extending from a leg being dimensioned for a different λo than another strip of the leg.

33. A dipole antenna for a wireless communication device comprising:

a generally U-shaped first conductive element on a first dielectric layer;

the first conductive element including a plurality of spaced conductive strips extending transverse from adjacent ends of the legs of the U-shape;

at lease one of the strips on each leg being T-shaped which includes a portion extending from one side of the head of the T-shape back towards the leg of the U-shape;

each strip extending from a leg being dimensioned for a different λo than another strip of the leg; and a coaxial feed having inner and outer conductors, each connected to a leg of the U-shape.

34. A dipole antenna for a wireless communication device comprising:

a generally U-shaped first conductive element on a first dielectric layer;

the first conductive element including a plurality of spaced conductive strips extending transverse from adjacent ends of the legs of the U-shape;

each strip extending from a leg being dimensioned for a different λo than another strip of the leg;

a coaxial feed having inner and outer conductors, each connected to a leg of the U-shape; and at least one of the strips including a first portion extending transverse to the leg of the U-shape, a second portion extending transverse to the first portion and a third portion extending into the first dielectric layer from the second portion.

35. A dipole antenna for a wireless communication device comprising:

a generally U-shaped first conductive element on a first dielectric layer;

the first conductive element including a plurality of spaced conductive strips extending transverse from adjacent ends of the legs of the U-shape;

each strip extending from a leg being dimensioned for a different λo than another strip of the leg;

a coaxial feed having inner and outer conductors, each connected to a leg of the U-shape; and a pair of conductive plates, each adjacent the strips of a leg of the U-shape at a pre-selected position.

36. The antenna according to claim 35, wherein the conductive plates position is adjustable.

* * * * *

UNITED STATES PATENT AND TRADEMARK OFFICE

CERTIFICATE OF CORRECTION

PATENT NO. : 7,095,382 B2
APPLICATION NO. : 10/859169
DATED : August 22, 2006
INVENTOR(S) : Emanoil Surducan et al.

It is certified that error appears in the above-identified patent and that said Letters Patent is hereby corrected as shown below:

Col. 4, Line 23 Should Read: Figure 8 shows the effect of changing the slot width S from 1 mm to 3 mm to 5 mm. The 3 mm slot width corresponds to Figure 6. Although there is not much change in the VSWR, there is substantial change in the S11 magnitude. For example, for the 5 mm strip, S11 is -21 dB at 2.5 GHz and -16 dB at 5.3 GHz. For the 3.3 mm strip, S 11is -14 dB at 2.5 GHz and -25 dB at 5. 3 GHz. For the 1 mm strip, S11 is approximately equal to -13 dB at 2.5 GHz and at 5.3 GHz.

Col. 4, Line 54, Should Read: A directional (or uni-directional) dipole antenna incorporating the principles of the present invention is illustrated in Figures 10b1 through 10B3. Those elements having the same structure, function and purpose as that of the omni-directional antenna of Figure 1 have the same numbers.

Col. 6, Line 24, Should Read: A modification of the antenna of Figure 24A is illustrated in Figure 24B. The strips 36, 37 have the generally T-shape, including portions 37A, 37B and 37C. Modifications of the strips 34, 35 are shown. The strip 34 includes a straight portion 34A extending transverse to the leg 33 and includes a head portion 34C forming an inverted L-shape. The length of strip 34 is shorter than that of strip 36. The short leg 34C of strip 34 and the equivalent part of strip 35 extend through the dielectric substrate 12 with vias 44. Similarly, portions 37B and 37C of strip 37 and the equivalent portion of strip 36 also include vias 46 extending through the dielectric substrate 12. The purpose of the design of the antenna in Figures 20, 24A, 24B and 24C is to extend the frequency bands to the TV and GSM low bands (400-800 MHz) maintaining or reducing the overall dimensions size of the antenna by folding or extending in Z direction (44, 46 element in Figures 24B and 24C) the dipole.

Col. 6, Line 47, Should Read: As an example, a dual-band dipole antenna of Figure 24A would have a width W of 22 mm and a length L of 40 mm. VSWR and the magnitude S11 are illustrated in Figure 25. VSWR is below 2 between 0.7 to 1.2 GHZ and 1.6 to 2.5 GHz. Directivity at phi of zero and three different thetas zero degree (Graph A), 12 degree (Graph B), and 10 degree (Graph C) are shown in Figure 26. The directional gain is illustrated in Figure 27 for three frequencies and thetas and a zero degree phi, namely 0.9 GHz, having a maximum gain of 5.15 dB for theta of 12 degrees (Graph A), 1.85 GHz having a maximum gain of 5.83 dB for theta 12 degrees (Graph B) and 2.05 GHz having a maximum gain of 5.97 dB for theta 10 degrees (Graph C).

UNITED STATES PATENT AND TRADEMARK OFFICE

CERTIFICATE OF CORRECTION

PATENT NO. : 7,095,382 B2
APPLICATION NO. : 10/859169
DATED : August 22, 2006
INVENTOR(S) : Emanoil Surducan et al.

It is certified that error appears in the above-identified patent and that said Letters Patent is hereby corrected as shown below:

Col. 7, Line 3, Should Read: Figures 28B and 28C show the structure of the antenna for coaxial feed corresponding to Figures 24B and 24C. One of the modifications is that strip's 37 base portion 37A and the corresponding portion of strip 36 include a trapezoidal portion 37D connected to leg 33 and a uniform width portion 37E extending therefrom to the head portion 37B. As mentioned previously, the serpentine pattern 37A and corresponding portion of strip 36 is illustrated in Figure 28C. This serpentine pattern may be curved and, therefore, sinusoidal, or it may be triangular or a saw tooth wave shape.

Signed and Sealed this

Sixteenth Day of January, 2007

JON W. DUDAS
*Director of the United States Patent and Trademark Office*